US011578583B2

(12) United States Patent
Samuel

(10) Patent No.: US 11,578,583 B2
(45) Date of Patent: Feb. 14, 2023

(54) DRILL BIT WEAR AND BEHAVIOR ANALYSIS AND CORRELATION

(71) Applicant: Landmark Graphics Corporation, Houston, TX (US)

(72) Inventor: Robello Samuel, Cypress, TX (US)

(73) Assignee: Landmark Graphics Corporation, Houston, TX (US)

( * ) Notice: Subject to any disclaimer, the term of this patent is extended or adjusted under 35 U.S.C. 154(b) by 0 days.

(21) Appl. No.: 17/303,284

(22) Filed: May 26, 2021

(65) Prior Publication Data

US 2022/0282609 A1 Sep. 8, 2022

Related U.S. Application Data

(60) Provisional application No. 63/156,066, filed on Mar. 3, 2021.

(51) Int. Cl.

| | |
|---|---|
| ***E21B 44/02*** | (2006.01) |
| ***E21B 49/00*** | (2006.01) |
| ***E21B 12/02*** | (2006.01) |
| ***E21B 47/002*** | (2012.01) |

(52) U.S. Cl.

CPC ..... *E21B 44/02* (2013.01); *E21B 12/02* (2013.01); *E21B 47/002* (2020.05); *E21B 49/003* (2013.01)

(58) Field of Classification Search

CPC ..... E21B 12/02; E21B 44/02; E21B 47/002; E21B 47/0025; E21B 49/003

See application file for complete search history.

(56) References Cited

U.S. PATENT DOCUMENTS

| | | | |
|---|---|---|---|
| 2010/0259415 | A1 | 10/2010 | Strachan et al. |
| 2011/0283839 | A1 | 11/2011 | Teodorescu et al. |
| 2013/0270007 | A1 | 10/2013 | Scott et al. |
| 2019/0145183 | A1 | 5/2019 | Potash |

FOREIGN PATENT DOCUMENTS

| | | | |
|---|---|---|---|
| WO | 2014066981 | A1 | 5/2014 |

OTHER PUBLICATIONS

Brandon, et al., "First Revision to the IADC Fixed Cutter Dull Grading System", IADCI/SPE 23939 was prepared for presentation at the 1992 IADCISPE Drilling Conference held in New Orieans, Louisiana, Feb. 18-21, 1992, 5 pages.

(Continued)

*Primary Examiner* — Kristyn A Hall
(74) *Attorney, Agent, or Firm* — Delizio, Peacock, Lewin & Guerra

(57) ABSTRACT

A method comprises determining a measure of drilling efficiency, such as a friction factor or mechanical specific energy, of a drill bit used in a drilling operation of a wellbore and performing video analytics of at least one video that includes a substantially complete view of the wear surfaces of a drill bit to determine drill bit wear of the drill bit that is a result of the drilling operation of the wellbore. The method includes determining a cause of the drill bit wear based on the measure of drilling efficiency and the drill bit wear determined by performing video analytics. Based on correlation or modeling of drill bit wear and the measure of drilling efficiency, drill bit wear can be predicted and some types of drilling dysfunction mitigated in subsequent drilling runs.

20 Claims, 10 Drawing Sheets

(56) References Cited

OTHER PUBLICATIONS

Chen, et al., "Drilling Performance Optimization Based on Mechanical Specific Energy Technologies", http://dx.doi.org/10.5772/intechopen.75827, 29 pages, 2018.
Kristensen, "Model of Hook Load During Tripping Operation", Norwegian University of Science and Technology, Department of Petroleum Engineering and Applied Geophysics, Jun. 2013, 84 pages.
Liu, et al., "An Analytical Model Coupled With Data Analytics to Estimate PDC Bit Wear", Society of Petroleum Engineers American and Caribbean Petroleum Engineering Conference, SPE 169451, Maracaibo, Venezuela, May 21-23, 2014, 7 pages.
Maidla, "Borehole Friction Assessment and Application to Oilfield Casing Design in Directional Wells", Historical Dissertations and Theses, 4461, https://digitalcommons.lsu.edu/gradschool_disstheses/4461, 1987.
McGehee, et al., "The IADC Roller Bit Dull Grading System", IADC/SPE 23938 was prepared for presentation at the 1992 IADC/SPE Drilling Conference held in New Orleans, Louisiana, Feb. 18-21, 1992, 16 pages.
Teale, "The Concept of Specific Energy in Rock Drilling", International Journal of Rock Mechanics and Mining Sciences & Geomechanics Abstracts vol. 2, Issue 1, Mar. 1965, pp. 57-73.
PCT Application No. PCT/US2021/070616, International Search Report, dated Dec. 2, 2021, 4 pages.
PCT Application No. PCT/US2021/070616, Written Opinion of the International Search Authority, dated Dec. 2, 2021, 5 pages.

DRILL BIT WEAR AND BEHAVIOR ANALYSIS AND CORRELATION

TECHNICAL FIELD

The disclosure generally relates to the field of earth or rock drilling or mining and more particularly to drill bit wear and behavior analysis and correlation.

BACKGROUND

Various types of drilling tools have been used to form wellbores in associated downhole formations. Examples of such drilling tools can include rotary drill bits, reamers, core bits, under reamers, hole openers, and stabilizers. Examples of such rotary drill bits can include fixed cutter drill bits, drag bits, polycrystalline diamond compact (PDC) drill bits, and matrix drill bits. Fixed cutter drill bits such as a PDC bit may include multiple blades that each include multiple cutting elements.

As a drill tool is used in a typical drilling application, the cutting elements experience wear. While the drill bit is in use downhole, direct measurement of drill bit wear is impeded by downhole conditions. As a cutting element wears, the cutting element can become less effective, can have a higher likelihood of failure, and can experience drilling dysfunction. Cutting element wear may have a significant effect on the rate of penetration (ROP). The ROP is important for reducing costs during drilling operations as a decrease in the ROP can increase drilling time and cost. ROP is impacted by several variables including the drilling tool type, geological formation characteristics, drilling fluid properties, drilling tool operating conditions, drill bit hydraulics, and drilling tool cutting element wear.

BRIEF DESCRIPTION OF THE DRAWINGS

Embodiments of the disclosure may be better understood by referencing the accompanying drawings.

DESCRIPTION OF EMBODIMENTS

Figure 1:
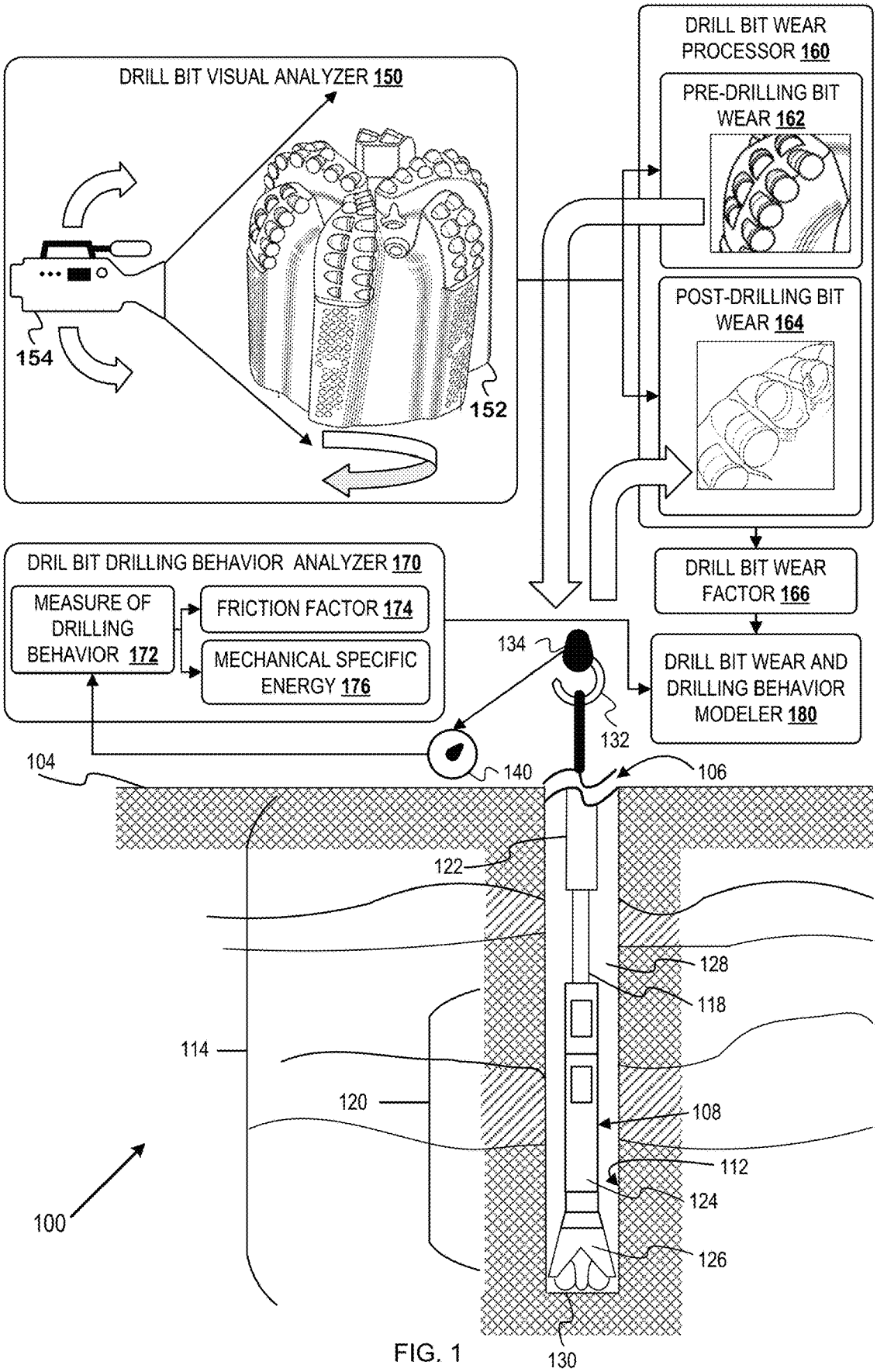
FIG. 1 depicts an example system for drill bit wear analysis, drill bit behavior analysis, and modeling of a correlation between drill bit wear and drilling behavior, according to some embodiments.

The description that follows includes example systems, methods, techniques, and program flows that embody embodiments of the disclosure. However, it is understood that this disclosure may be practiced without these specific details. For instance, this disclosure refers to wellbore drilling in illustrative examples. Embodiments of this disclosure can be also applied to other drilling applications such as coring, casing drill out, reaming, etc. In other instances, well-known instruction instances, protocols, structures and techniques have not been shown in detail in order not to obfuscate the description.

Example embodiments evaluate or grade wear or dullness of a drilled bit using visual analytics and real-time analysis. Using such analytics and analysis, example embodiments can also determine possible causes of the wearing or dulling of the drill bit. For example, based on a set of correlations between drill bit wear and drill bit behavior during drilling, drilling parameters (such as a friction factor or mechanical specific energy) can be correlated to drilling dysfunction or performance in real time and drill bit wear predicted.

As wellbores are drilled deeper and through harder lithography and with both more complex wellbore geometries and drill bit geometries, the inability to detect or monitor drill bit wear and damage as it occurs can impede drilling progress. The environment downhole precludes real-time monitoring via video monitoring and can impede real-time data transmission. Drill bit design and behavior can be improved if drill bit damage and wear can be identified as it occurs as well as where it occurs. For example, information about depth and conditions in the wellbore and formation type at a depth where drill bit damage and wear occur can be used to improve drill bit design and behavior. Additionally, reduction of drill bit wear (and damage) and reduction of dysfunctional drilling behaviors can reduce cost per foot of drilling and can reduce unexpected drill bit failure.

A universal model that describes drill bit wear or damage accurately has not been available because of the complex nature of downhole conditions. Example embodiments can combine analytical models with real-time data analytics to estimate and predict wear of a drill bit based on drilling behavior and knowledge of drill bit wear. Some embodiments can include an analytical bit wear model coupled with data analytics using real-time gamma ray data to reduce uncertainties in formation properties and other variables, where formation properties influence rate and type of drill bit wear.

The International Association of Drilling Contractors (IADC) encourages grading of a used bit (i.e., a dull bit) and inclusion of the dull bit grading as an essential part of drill bit records. To that end, the IADC developed a standard methodology to describe worn drill bits. In the IADC grading system, each dull bit grade is composed of an eight-point alphanumeric code that defines the cutting structure, bearing condition, gauge conditions, and other dull conditions. This multi-point code can also define the reason the bit was pulled or run terminated, using a prescribed field of alphanumeric grading values. The IADC dull grading system can be applied to any type of roller cone and fixed cutter bits. For example, this grading system can be used to grade and describe drill bits with steel teeth, tungsten-carbide inserts, natural or synthetic diamond cutters, etc.

Prior to development of the IADC dull grading system, evaluating dull drill bits to determine what type of drill bit to use in a subsequent run was a qualitative skill developed through personal experience—essentially an art that distinguished a superior driller from another. The IADC dull grading system was developed to make it easier for drilling personnel to identify and classify bit dullness and to determine which drill bits could be re-used, which drill bits needed to be refurbished, and which drill bits should be discarded. Even with the IADC dull grading system, the evaluation of bit dullness (or bit wear) can be affected by subjective evaluation or operator skill. Example embodiments provide automated operations able to detect drill bit dullness which avoid operator subjectivity.

Example embodiments can include a quantitative evaluation system or wear estimation model for drill bit dullness or drill bit wear. This quantitative system can measure degradation to wear surfaces of the drill bit. The wear of individual cutter elements can be determined, as well as a wear factor for regions of the drill bit, or the drill bit as a whole. In some embodiments, the wear estimation model can be convertible to and back compatible with the IADC dull bit grading system. The wear estimation model can be applied to drill bits in the field based on visual analytics applied to videos, taken at the wellbore, of drill bits before and after drilling runs. Video data can be incorporated with advances in computation to present an efficient technique to identify bit dullness qualitatively or according to the IADC grading system based on differences between a pre and a post-drilling drill bit. In some example embodiments, a video recording of a used drill bit can be processed and deep learning techniques applied to automatically identify drill bit wear or dullness. The grading of a drill bit dullness according to the IADC dull bit grading system can be a beneficial tool for both drillers and drill bit manufacturers. However, the grading process can be affected by the personal skills of an evaluator. Example embodiments can provide an automated technique to analyze drill bit dullness using visual analytics of video of the drill bits.

Dull grading of drill bits can be essential for drilling planners and operators as well as the bit manufacturers. Such grading helps field personnel, who are responsible for preparing drilling programs, select proper bits to drill efficient and economic wells. Bit manufacturers can use grading to design better drill bits and tools for drilling, especially if drill bit wear is correlated to drilling dysfunction or formation properties.

For example, the fractional bit wear of polycrystalline diamond compact (PDC) bit cutters can be obtained from the geometric correlation between height loss and the cutter volume loss. The cutter volume loss can be assumed to be proportional to weight on bit (WOB), cutter sliding distance, rock strength, and rock quartz content of the used drill bits. Based on the change in drill bit wear during a drilling run, drill bits for other runs or in similar wells can be improved.

Example System

FIG. 1 depicts an example system for drill bit wear analysis, drill bit behavior analysis, and modeling of a correlation between drill bit wear and drilling behavior, according to some embodiments. FIG. 1 includes a schematic diagram of an example drilling apparatus 100, including a drill bit 126 in a wellbore 112, a schematic diagram of a drill bit visual analyzer 150, a schematic diagram of a drill bit wear processor 160, a schematic diagram of a drill bit drilling behavior analyzer 170, and a drill bit wear and drilling behavior modeler 180.

Drilling of oil and gas wells is commonly carried out using a string of drill pipes connected together so as to form a drilling string 108 that is lowered through a rotary table into a wellbore or wellbore 112. The drill string 108 may operate to penetrate the rotary table for drilling the wellbore 112 through subsurface formations 114. The drill string 108 may include a Kelly, drill pipe 118, and a bottom hole assembly (BHA) 120, perhaps located at the lower portion of the drill pipe 118. The drilling apparatus 100 may also include a drilling rig located at the surface 104 of a well 106, where the drilling rig is not shown here for simplicity. The drill rig can include a hook 132 and a traveling block 134 or other drill string support or suspension mechanisms. The total force pulling down on the drill string is measured as a hook load 140. The total force includes the weight of the drill string, frictional forces, and other downward and upward forces that alter the weight of the drill string experienced at the surface. The hook load 140 is measured during the course of drilling, at the hook 132 or another drill string support. The hook load 140 can change as a result of various drilling events downhole and is therefore indicative of drill bit or BHA position such as drill bit off bottom, set-down or slack-off, pick-up, etc. and drilling events such as formation kick, wellbore fluid influx, etc. and can be correlated with drilling conditions and parameters such as rotations per minute (RPM), weight on bit (WOB), torque on bit (TOB), rate of penetration (ROP), etc.

The BHA 120 may include drill collars 122, a down hole tool 124, and a drill bit 126. The drill bit 126 may operate to create a wellbore 112 by penetrating the surface 104 and subsurface formations 114. The down hole tool 124 may comprise any of a number of different types of tools including a mud pump, MWD tools, LWD tools, and others.

During drilling operations, a mud pump may pump drilling fluid (sometimes known by those of ordinary skill in the art as "drilling mud") from a mud pit through a hose into the drill pipe and down to the drill bit 126. The drilling fluid can flow out from the drill bit 126 and be returned to the surface 104 through an annular area 128 between the drill pipe 118 and the sides of the wellbore 112. The drilling fluid may then be returned to the mud pit, where such fluid is filtered. In some embodiments, the drilling fluid can be used to cool the drill bit 126, as well as to provide lubrication for the drill bit 126 during drilling operations. Additionally, the drilling fluid may be used to remove subsurface formation 114 cuttings created by operating the drill bit 126.

During drilling operations, the drill string 108 (perhaps including the Kelly, the drill pipe 118, and the BHA 120) may be rotated by the rotary table. In addition to, or alternatively, the BHA 120 may also be rotated by a motor (e.g., a mud motor) that is located down hole. The drill collars 122 may be used to add weight to the drill bit 126. The drill collars 122 may also operate to stiffen the BHA 120, allowing the BHA 120 to transfer the added weight to the drill bit 126, and in turn, to assist the drill bit 126 in penetrating the surface 104 and subsurface formations 114.

The drill bit 126 can contact a bottom 130 (of a vertical wellbore) or lateral end (of a lateral wellbore) of the wellbore 112 in order to advance the progress of the wellbore drilling. The efficiency of drilling and the forces on the drill bit 126 and the BHA 120 are affected by the position of the drill bit 126 relative to the bottom 130 of the wellbore 112. Depth of the drill bit 126 in the wellbore can be measured by the length of the drill string 108 or other parameters at the surface 104, but in cases where the drill bit experiences vibrations or non-idealities such as axial displacement, bending, stick-slip, etc. the drill bit 126 can come into and out of contact with the bottom 130 of the wellbore 112 during drilling and can also experience fits and starts in rotational movement. The hook load 140 can function as a measure of drill bit 126 contact with the bottom 130 of the wellbore 112 and of rotational friction (i.e., static friction versus kinetic friction, torque, etc.).

The drill bit visual analyzer 150 can be located at one or more locations, including at the surface 104 on the rig or otherwise near the well 106. The drill bit visual analyzer comprises a video recording device 154, which may be any video recorder including a video camera, a cell phone camera, a handheld tablet camera, etc., which records or transmits video or photographic images of cutting surfaces of a drill bit 152. The video recording device 154 can be used to capture video or images of at least a portion of the cutting surfaces of the drill bit 152. In some embodiments, the video recording device 154 can capture video or images of all or substantially all of the cutting surfaces of the drill bit 152. As video images are comprised of sequential photographs or image frames, a video recording or video image is interchangeable with a sufficiently large number of still photographs. Hereinafter, "video" is used to describe both videos (e.g., recorded moving images) and sets of photographs (e.g., recorded still images). The video recording device 154 can record video at the location of the drill bit 152 or can transmit video to another location, such as at a data storage facility, for storage. The video recording device 154 and/or the drill bit 152 can be moved such that video of at least a portion of the cutting surface of the drill bit is recorded. The drill bit 152 can be attached to a BHA or other drill string parts, such as a bit sub or any other sub, rotary connection, etc. The drill bit 152 can be attached to a sub suspended from a hook or rotary block, located in a "flowerpot" or other receptacle on a rig or at the surface, disconnected from any sub or drilling apparatus, etc. The drill bit 152 can be oriented with its drilling surfaces upward, downward, or in any other direction. In order to obtain video of at least a portion of the cutting surfaces of the drill bit 152, the video recording device 154 can be rotated and pivoted, the drill bit 152 can be rotated and pivoted, or both the video recording device 154 and the drill bit 152 can be rotated and pivoted. The drill bit visual analyzer 150 can obtain video of the cutting surfaces of the drill bit 152 whenever the drill bit 152 is removed from the well, including before the drill bit 152 is attached to the drill string or used in the well 106 (i.e., on the drill bit 152 when it is new).

The drill bit 152 can be any drill bit, such as the drill bit 126 of the drilling apparatus 100, a rotary bit such as a fixed cutter-bit (i.e., a poly crystalline diamond compact (PDC) bit, an impregnated bit, a diamond bit, etc.), a rotary bit such as a roller-cone bit (i.e., a tungsten carbide insert (TCI) bit, a milled-tooth bit, etc.), a coring bit, a reaming bit, a sidetracking bit, etc.

The drill bit wear processor 160 operates on video from the drill bit visual analyzer 150 to calculate a drill bit wear factor 166. The drill bit wear processor 160 operates on video obtained of the drill bit 152 before drilling to produce a measurement of pre-drilling bit wear 162. Optionally, the drill bit wear processor 160 may operate on a three-dimensional (3D) representation or measurements of a planned or as-manufactured drill bit (such as AutoCAD files or the like) instead of video analysis to produce the pre-drilling bit wear 162—for drill bits which have never been drilled or are newly manufactured. Use of as-manufactured measurements or specifications pre-supposes that a manufactured drill bit is substantially identical to manufacturing specifications, which may not be the case if there are any manufacturing defects. In some cases, even if as-manufactured measurements or specification are available, the drill bit wear processor 160 will operate on video of the drill bit visual analyzer 150. In cases where the drill bit 152 has been previously drilled and is to be used again, the drill bit wear processor 160 can operator on a video of the drill bit 152 recorded after the previous drilling run or can re-record video of the drill bit 152. If the history of the drill bit 152 is unknown or uncertain (which can be the case if the drill bit 152 was stored or shipped after a previous drilling run), the drill bit wear processor 160 can preferentially operate on or prompt collection of video obtained by the drill bit visual analyzer 150 prior to the drilling run to produce the pre-drilling bit wear 162.

The drill bit wear processor 160 operates on video obtained of the drill bit 152 after drilling to produce a measurement of post-drilling bit wear 164. The drill bit visual analyzer 150 captures video of the drill bit 152 after a drilling run. The drilling run can comprise any combination of the drill string run into and out of the wellbore 112. In some instances, the drilling run may involve running the drill string into and out of the wellbore 112 without advancing the wellbore—for example, if the drilling run is terminated for excessive hook load before the drill bit 152 is used to advance the wellbore 112. The drill bit 152 can sustain wear or damage even if the drill bit 152 is not rotated or drilled in the wellbore 112, such as due to cave in in uncased portions of the wellbore, due to narrowing of the wellbore 112 because of a previously under-gauge drilling run, due to drill string collision with the casing during a formation kick, etc. The drilling run can comprise wellbore 112 widening, drilling of laterals, or any other wellbore operation.

The drill bit wear processor 160 determines the drill bit wear factor 166 based a difference between the pre-drilling bit wear 162 and the post-drilling bit wear 164. The drill bit wear factor 166 can comprise a volumetric measure of drill bit or cutter wear (i.e., a measure of volume lost between the pre-drilling bit wear 162 and the post-drilling bit wear 164). The drill bit wear factor 166 can be calculated for individual cutters, for portions of the drill bit 152 (i.e., for the gauge, for the cutters of inside a cone of the drill bit 152, for the cutters of a blade of the drill bit 152, etc.), or for the drill bit 152 as a whole. The drill bit wear factor 166 can be calculated as a volume lost during drilling (i.e., to wear) for a drill bit or element of a drill bit, as a height loss for an element of a drill bit, as a fractional, normalized, dimensionless, etc. quantity or a quantity corresponding to volume, area, length, etc.

The drill bit wear factor 166 can be calculated using Equations 1 and 2 for abrasive volume loss of a cutter, below:

$$y_i^3 = \left(\frac{\Delta h}{h}\right)^3 = \frac{1}{8}\frac{\Delta V}{V_0} = \frac{1}{8}\sum_{i=1}^{n} 2.5\pi\frac{\beta}{V_0}\alpha_{0i}\frac{S_i^2 D_b^2 X_i}{(1-y_i)G} \tag{1}$$

$$y_i^3 = 2.5\pi\frac{\beta}{8V_0}\alpha_{0i}\frac{S_i^2 D_b^2 X_i}{(1-y_i)G} + y_{i-1}^3 \tag{2}$$

where $y_i$ is the fractional height of a cutter lost for the interval i (e.g. a fractional bit wear), $y_i$ is the fractional height of the cutter at the beginning of the interval (i.e., the fractional height lost in intervals 1 to i−1), Δh is the change in cutter height, h is the initial cutter height, ΔV is the volume of the cutter lost to bit wear, $V_0$ is the volume of the cutter approximated as a truncated cylinder with a flat surface through the bottom circle center, β is the dimensionless abrasive constant for the formation, $\alpha_{0i}$ is the normalized, dimensionless rock quartz content for the interval i, $S_i$ is the confined rock strength for the interval i in pounds per square inch (psi), $D_b$ is the bit diameter in inches, $X_i$ is distance the drill bit advances in feat for the interval i, and G is a model constant.

The drill bit wear factor 166 can be converted between the fractional bit wear $y_i$ and a wear factor $W_f$ using Equation 3, below:

$$W_f = 1 - \frac{\Delta h}{h} = 1 - y_i = 1 - \frac{\Delta BG}{8} \quad (3)$$

where ΔBG is change in bit grade in the IADC dull grading system for a cutter. In the IADC dull grading system a linear scale running between zero (0) and eight (8) is used to grade the condition of cutting structures (or cutters). The value zero represents no loss of cutting structure, while the value eight represents total loss of cutting structure. The first and second elements of the IADC dull bit grading system correspond to evaluation of the inner and outer cutting structures, respectively. The change in bit grade ΔBG can also be expressed using Equation 4, below:

$$\Delta BG = 8\frac{\Delta h}{h} = 8y_i \quad (4)$$

Conversion between a wear factor and the change in bit grade means that the volumetric bit grading system is compatible with and convertible to the IADC dull grading system. The change in bit grade ΔBG can also be determined based on drilling parameters, as shown in Equation 5, below:

$$\Delta BG = C_a \sum_{i=1}^{n} \left[ RPM^{C3} \left( \frac{WOB}{1000} \right)^{c4} \left( \frac{\sigma}{1000} \right) X_i \right] \quad (5)$$

where $C_a$, is a fitting factor, c3, and c4 are calibration parameters, RPM is the RPM during the interval i, WOB is the weight on bit during the interval i, σ formation stress and $X_i$ is distance the drill bit advances in feat for the interval i.

The drill bit drilling behavior analyzer 170 operates during drilling or on data collected during drilling to analyze drill bit behavior. The drill bit drilling behavior analyzer 170 can operate on a measure of drilling behavior 172, such as the hook load 140, as a function of time to determine a friction factor 174 during drilling. A mechanical specific energy (MSE) 176 or other measure of drilling efficiency can be used instead of the friction factor 174. Hereinafter, the "measure of drilling efficiency" is used to represent the friction factor 174, the MSE 176, or any other appropriate measure of drilling efficiency or behavior determined based on values of the measure of drilling behavior 172 of a drilling run. The drill bit drilling behavior analyzer 170 can operate in real time or on historical data of one or more drilling runs associated with the drill bit 152. The drill bit drilling behavior analyzer 170 can identify periods of drilling dysfunction, which may include classification of drilling dysfunction (i.e., stick-slip, whirl, etc.), that correspond to sub-optimal drilling. The drill bit drilling behavior analyzer 170 can identify events which can cause drill bit wear or drilling dysfunction—such as formation kick, transition from a cased wellbore to an uncased wellbore, turns in directional drilling, etc. Such events may or may not be reflected in changes to the measure of drilling behavior 172 or the measure of drilling efficiency and may or may not cause periods of drilling dysfunction. The drill bit drilling behavior analyzer 170 can identify trends in the measure of drilling behavior 172 or the measure of drilling efficiency. The drill bit drilling behavior analyzer 170 can identify changes in drilling parameters, such as RPM, WOB, TOB, etc. The drill bit drilling behavior analyzer 170 can calculate an expected or predicted value of the measure of drilling efficiency. Such a calculation can be dependent on various drilling parameters and may change when drilling parameters change. The drill bit drilling behavior analyzer 170 can determine a difference between an expected measure of drilling efficiency and a calculated measure of drilling efficiency. The drill bit drilling behavior analyzer 170 may also track behavior of the measure of drilling behavior 172 or the measure of drilling efficiency, such as for statistical analysis by determining a standard deviation, trend, slope, etc.

The drill bit wear and drilling behavior modeler 180 can operate on the drill bit wear factor 166 and the measure of drilling efficiency. The drill bit wear and drilling behavior modeler 180 can be any model or correlation identifier or generator, included in the drill bit wear processor 160, included in the drill bit drilling behavior analyzer 170, or operating as any other appropriate controller, processor, etc. The drill bit wear and drilling behavior modeler 180 can correlate periods of drilling dysfunction or drilling events to bit wear. For example, a formation kick or influx of formation gas can cause a BHA to collide with a wellbore or casing. A collision with a casing can cause a drill string, BHA or drill bit to become damaged on one side and therefore cause rotational asymmetry. Rotational asymmetry can be exacerbated by rotational drilling, leading to drill bit wear or damage on one side of the drill bit due to uneven loading and torsional forces. If the drill bit drilling behavior analyzer 170 has identified an event or instance of dysfunction in the measure of drilling behavior 172 or the measure of drilling efficiency, the drill bit wear and drilling behavior modeler 180 can correlate that event to identified or characteristics drill bit wear or damage in the post-drilling bit wear 164 or represented by the drill bit wear factor 166.

The drill bit wear and drilling behavior modeler 180 can output a predictive model of the drill bit wear factor 166 based on the measure of drilling behavior 172 or the measure of drilling efficiency, a backward-looking model of the measure of drilling behavior 172 or the measure of drilling efficiency based on the drill bit wear factor 166, or can output a single model or group of models relating the measure of drilling behavior 172 or the measure of drilling efficiency and the drill bit wear factor 166. The drill bit wear and drilling behavior modeler 180 can iteratively refine or update the model based on subsequent drilling runs for the drill bit 152 or additional drill bits.

Example Operations

Figure 2:
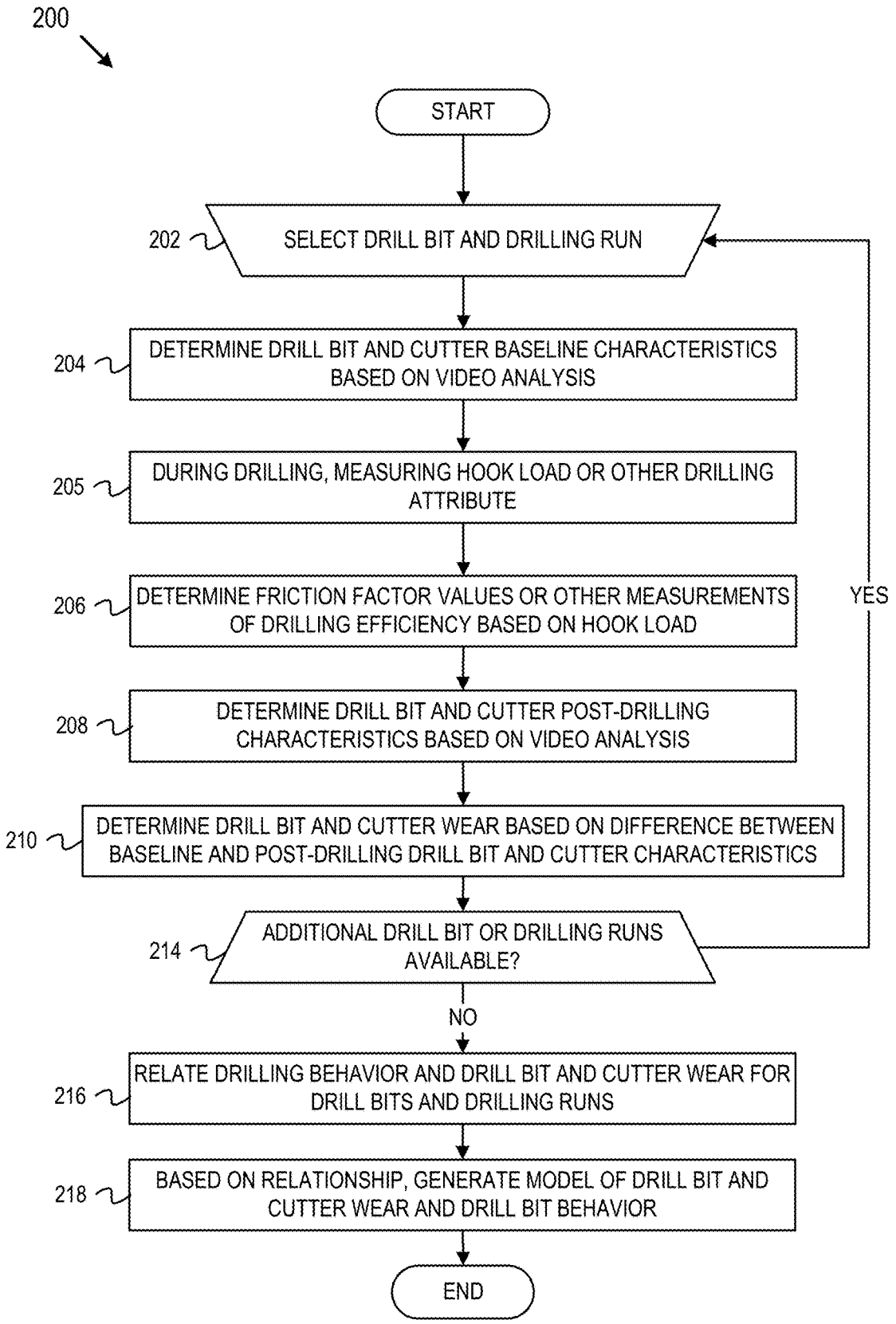
FIG. 2 depicts a flowchart of example operations for generating a model of drill bit and cutter wear, according to some embodiments.
Figure 5:
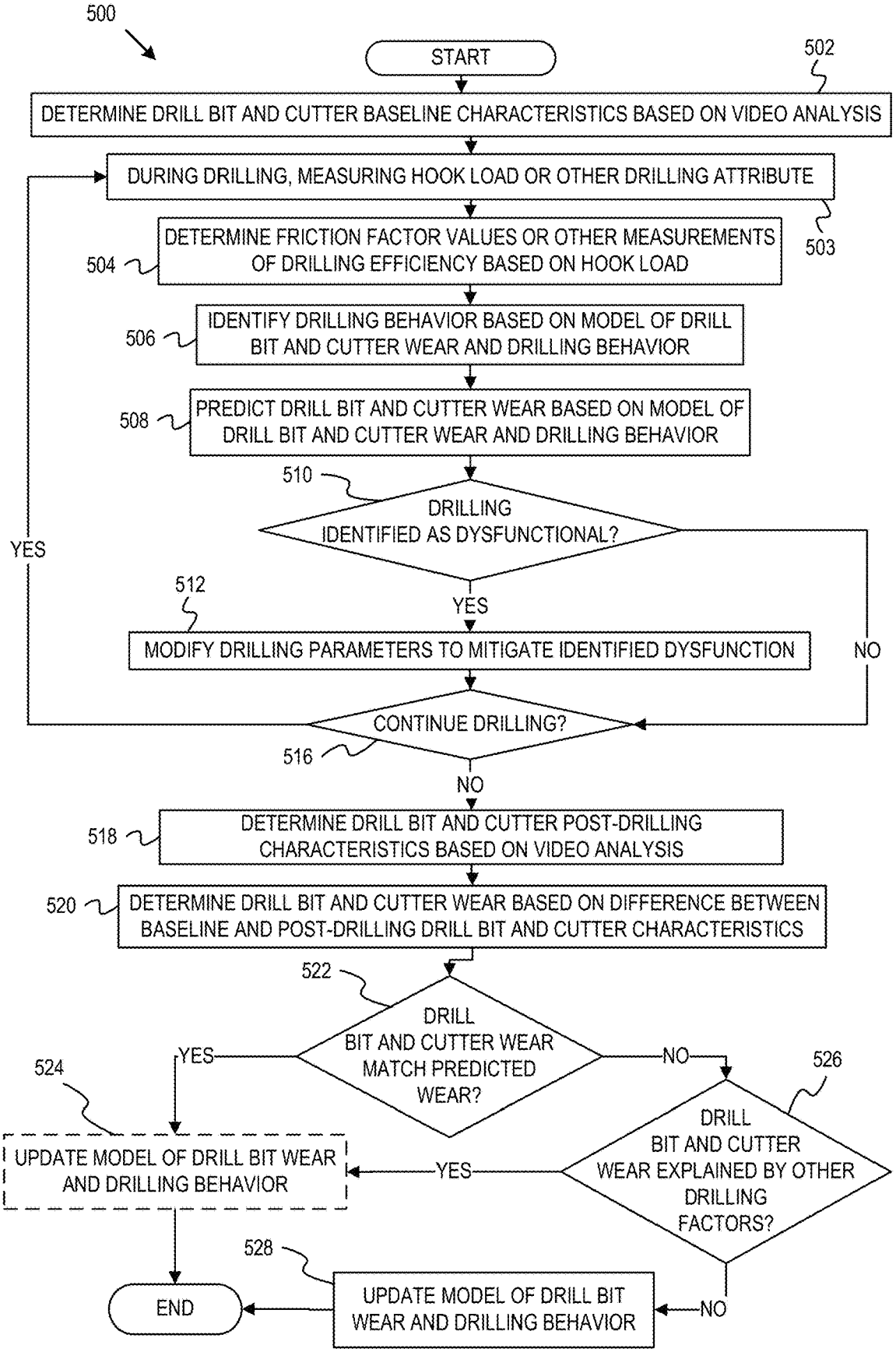
FIG. 5 depicts a flowchart of example operations for using and updating the model of drill bit and cutter wear during drill operations, according to some embodiments.

Example operations are now described in reference to the example drilling apparatus 100 of FIG. 1. FIG. 2 depicts example operations for generating a model of wear of a drill bit and cutters thereon. Whereas FIG. 5 depicts example operations for using and updating the model generated by operations depicted in FIG. 2.

FIG. 2 depicts a flowchart of example operations for generating a model of drill bit and cutter wear, according to some embodiments. A flowchart 200 of FIG. 2 includes operations described as performed by the drill bit wear and drilling behavior modeler 180 for consistency with the earlier descriptions. Such operations can be performed by a controller or processor, hardware, firmware, software, or a combination thereof of one or more computers, including asynchronously. However, apparatus component naming, division, organization, and program code naming, organization, and deployment can vary due to arbitrary operation choice, ordering, programmer choice, programming language(s), platform, etc. Additionally, operations of the flowchart 200 are described in reference to the example apparatus 100 and the drill bit visual analyzer 150, the drill bit wear processor 160, the drill bit drilling behavior analyzer 170, and a drill bit wear and the drilling behavior modeler 180 of FIG. 1. The flowchart includes the operations of blocks 202, 204, 206, 208, 210, 214, 216, and 218 described as performed by the drill bit wear and drilling behavior modeler 180. However, one or more of the operations described as being performed by the drill bit wear and drilling behavior modeler 180 may be performed by one or more of the drill bit visual analyzer 150, the drill bit wear processor 160, and the drill bit drilling behavior analyzer 170.

At block 202, a drill bit and drilling run is selected. For example, a drill bit can be selected for a drilling run to be drilled, or a drill bit and drilling run can be selected from a set of historical drilling data. For example, with reference to FIG. 1, the drill bit wear and drilling behavior modeler 180 can select a drill bit and drilling run. A drill bit can be selected for a drilling run to be drilled by an operator or controller. The drill bit can be selected, and then a drilling run in which the drill bit was drilled, or a drilling run can be selected and then the drilling bit used for the drilling run is also selected. In some embodiments, the drill bit can correspond to multiple drilling runs. In some cases, a drilling run can correspond to two or more drill bits, such as a reaming drill bit and a PDC drill bit. In many cases, a drilling run will correspond to only one drill bit or to a primary drill bit for a drilling run with two or more drill bits. The drill bit and drilling run can be selected in chronological order, for example when real time analysis occurs. Alternatively or in addition, the drill bit and drilling run can be selected from a database based on input order or any other factors. For drill bits which correspond to multiple drilling runs, drilling runs of the drill bit can be selected in sequential iterations. Drilling runs can also be ordered for selection by formation type, drill bit type or family, etc.

At block 204, drill bit and cutter baseline characteristics are determined based on video analysis. For example, with reference to FIG. 1, the drill bit visual analyzer 150 can determine the drill bit and cutter baseline characteristics. At least a portion of the cutting surfaces of the drill bit can be recorded on video. In some implementations, all or substantially all of these cutting surfaces can be recorded. The volume of the drill bit can be measured or the video of the pre-drilling drill bit can be stored for measurement of a difference between the pre-drilling drill bit and the post-drilling drill bit at block 210 (described below).

At block 205, hook load or other drilling attributes are measured during drilling. For example, with reference to FIG. 1, the drill bit drilling behavior analyzer can measure or determine the hook load values or values of other drilling attributes. The hook load can be measured directly from a scale, spring, at a block, etc. or can be detected or determined based on measurement of forces experiences at the drill string, hook, traveling block, etc. A drilling attribute other than hook load can be used alone or in combination to detect drilling forces, such as damping force, tension in the dead-line, block position, block velocity, drill string torque, drill string RPM, mud weight, etc.

Figure 3B:
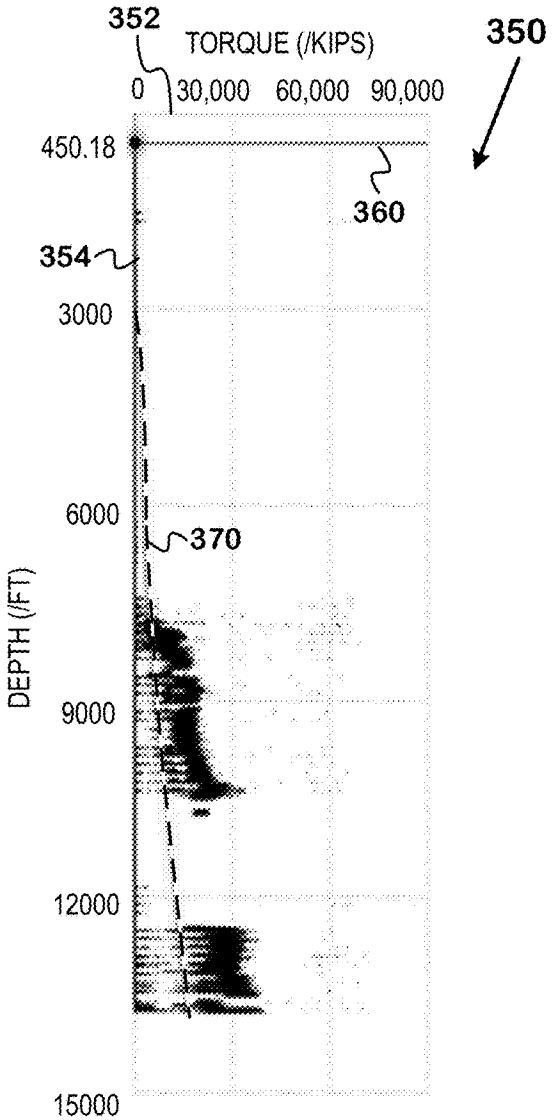
FIGS. 3A-3B depict example graphs for hook load and torque obtained during drilling, according to some embodiments.
Figure 3A:
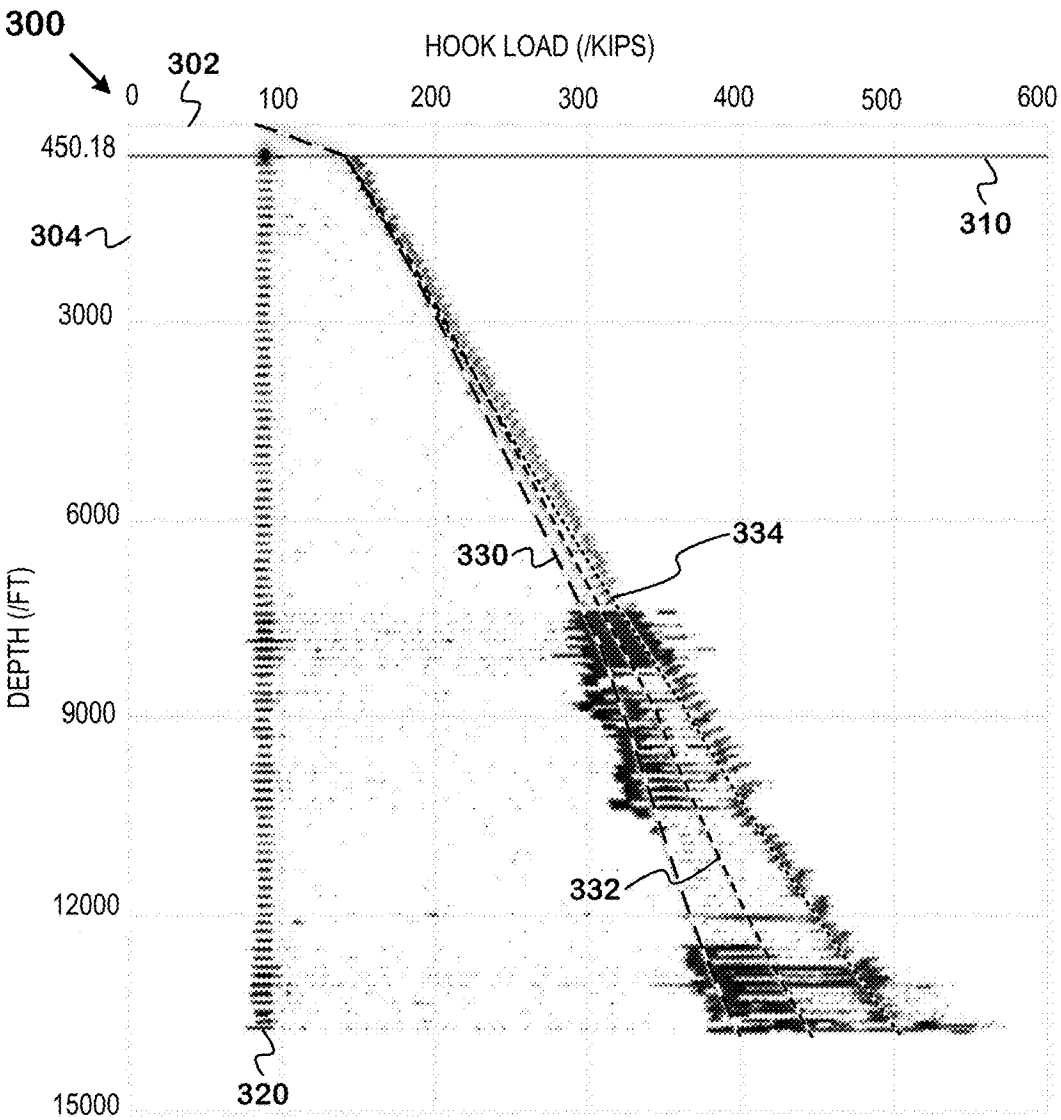

To help illustrate, FIGS. 3A-3B depict example graphs for hook load and torque obtained during drilling, according to some embodiments. FIG. 3A depicts a graph 300 displaying an example plot of hook load (on x-axis 302) measured in kips (also known as kilopounds and equal to one thousand (1,000) pounds-force) as a function of depth (on y-axis 304) measured in ft in a wellbore. Line 310 corresponds to a depth of 450.18 ft, which is the depth below which the drill string experiences significant upward force thereby reducing the hook load from the weight of the drill string in air. A set of points 320, oriented vertically at an approximate value of 89.36 kips, represents the minimum hook load. Dashed line 330 represents the hook load values corresponding to slack off, or the released drill string weight measured when the pipe is freely rotating. At slack off, kinetic friction rather than static friction affects hook load. Dashed line 332 represents the hook load values corresponding to drill bit rotating off bottom. When the drill bit is off bottom, WOB is not transferred to the formation and hook load is greater than the released drill string weight. Dashed line 334 represents the hook load values corresponding to pick up. At pick up, static friction opposes the motion of the drill string and can increase the hook load. The slope in dashed lines 330, 332, and 334 is due to the increased hook load as a function of depth.

FIG. 3B depicts a graph 350 displaying an example plot of torque (on x-axis 352) measured in kips as a function of depth (on y-axis 354) measured in ft in a wellbore. Line 360 corresponds to a depth of 450.18 ft, where the drilling run begins. Dashed line 370 corresponds to a rotating off-bottom plan, or the amount of torque at a given depth expected or predicted to correspond to rotation of the drill bit and drill string in the wellbore. The off-bottom plan is the amount of torque caused by rotation of the drill bit and drill string and opposed by kinetic friction. The off-bottom plan does not include torque applied to the drill bit and drill string by the end of the wellbore or by the formation. The slope of the dashed line 370 is due to the increased torque required as a function of depth. FIGS. 3A and 3B are example graphs, where measurement of hook load and torque can be used to calculate measurements of drilling efficiency.

At block 206, friction factor values or other measurements of drilling efficiency are determined based on hook load. For example, with reference to FIG. 1, the drill bit drilling behavior analyzer 170 can determine the friction factor values or other measurements of drilling efficiency. The friction factor can be calculated based on the hook load and a comparison of actual hook load and predicted load as shown in Equation 6, below:

$$FF = \left| \frac{\text{DRILL STRING WEIGHT IN AIR} - \text{MEASURED HOOK LOAD}}{\text{DRILL STRING WEIGHT IN AIR}} \right| \tag{6}$$

where FF is the dimensionless friction factor (FF), the drill string weight in air is the weight of the components of the drill string when measured suspended in air, and the measured hook load is hook load or weight of the suspended drill string measured at the surface. The measured hook load is reduced by the buoyant effects of drilling mud, WOB transferred to the wellbore, etc.

The dimensionless friction factor FF can be predicted or estimated for a drilling run, where drilling runs in the same wellbore tend to have similar FF values. The FF can be affected by different attributes of the drilling operation (such as, the location of the drill string, BHA, drill bit in the wellbore, etc.). For an example wellbore, the predicted FF can be 0.25 in the casing and 0.3 in an open hole portion of the wellbore. The FF can also be affected by wellbore geometry. For example, lateral wellbores can have smaller predicted FF as the drill string is supported by the lateral portions of the wellbore. Because of variations in static and kinetic friction (and other drilling parameters), the FF can vary with RPM, with WOB, when the drill bit is off bottom, etc.

Alternatively or in addition, a measurement of mechanical specific energy (MSE) can be used as a measure of drilling efficiency. MSE can be calculated using Equation 7, below:

$$E_s = \frac{WOB}{A} + \frac{120\pi * RPM * TOB}{A * ROP} \tag{7}$$

where $E_s$ is the MSE in psi, A (in square inches or $in^2$) is the cross-sectional area of hole drilled by the drill bit, WOB is the weight on bit, TOB is torque on bit, ROP is rate of penetration, and RPM is revolutions per minute (rev/min) of the drill bit. MSE represents the energy required to remove a unit volume of rock, and decreases with increased drilling efficiency.

A drilling efficiency can be calculated based on the MSE, such as using Equation 8, below, or any other appropriate relationship.

$$DE = \frac{\sigma_{rock}}{E_s} * 100\% \tag{8}$$

where DE is the drilling efficiency (DE) as a percentage and $\sigma_{rock}$ is the rock compressive strength in psi.

Figure 4A:
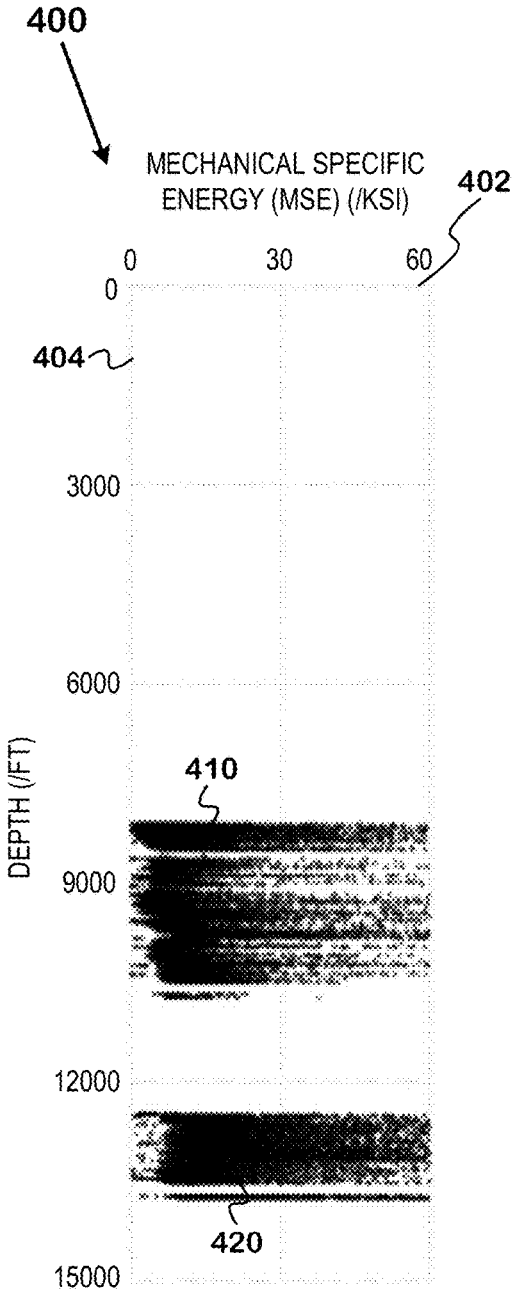
FIGS. 4A-4B depict example graphs showing calculations of mechanical specific energy (MSE) and of a dimensionless friction factor during drilling, performed according to some embodiments.
Figure 4B:
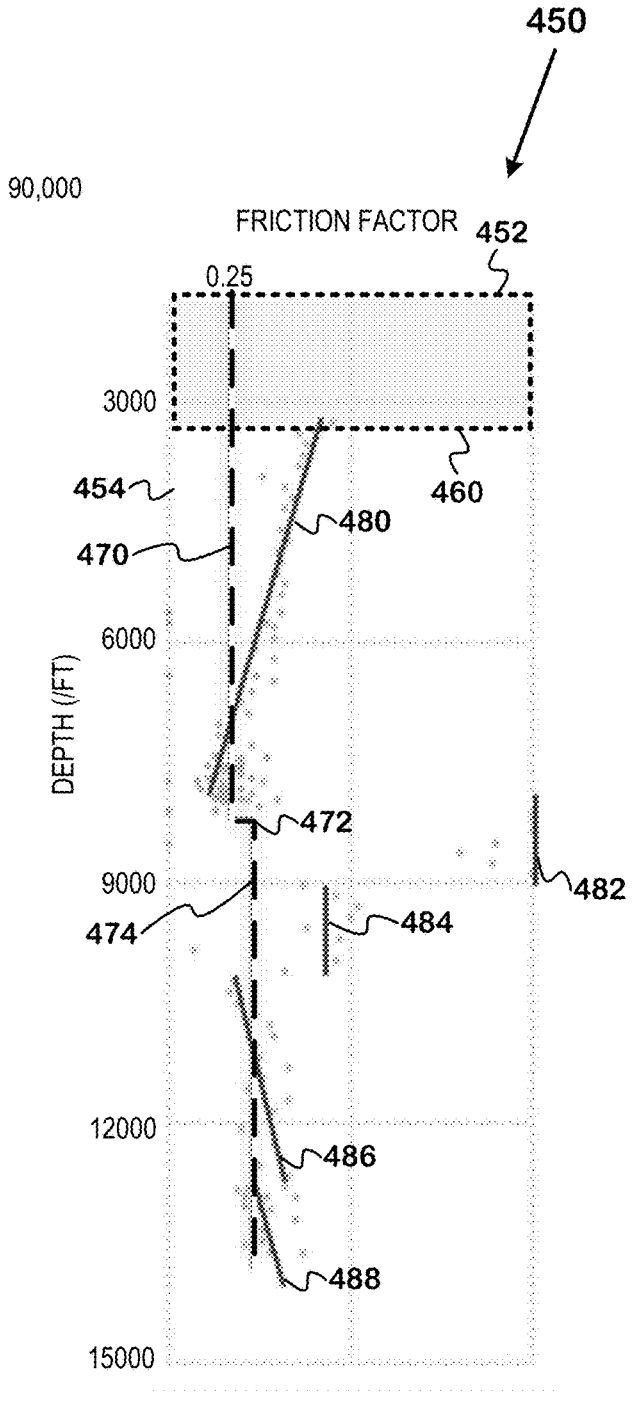

To help illustrate, FIGS. 4A-4B depict example graphs showing calculations of mechanical specific energy (MSE) and of a dimensionless friction factor during drilling, performed according to some embodiments. FIG. 4A depicts a graph 400 displaying an example plot of MSE (on x-axis 752) measure in kilopounds per square inch (ksi where 1 ksi is equal to 1000 psi) as a function of depth (on y-axis 404) measured in ft in a wellbore. The calculated MSE value displays high values in a region 410 between approximately 8,000 and 10,000 ft of depth, and in a region 420 between approximately 13,000 and 14,000 ft in depth. The high values of MSE can be correlated to drilling dysfunction, as previously described.

FIG. 4B depicts a graph 450 displaying an example plot of a dimensionless friction factor (on x-axis 452) as a function of depth (on y-axis 454) measured in ft in a wellbore. Depths above approximately 3,745.44 ft are included in a box 460. The dimensionless friction factor is not shown for these depths, which may correspond to depths drilled out by previous drilling run. A dashed line 470 corresponds to planned or predicted friction factor (FF) values of the well for drilling within a cased wellbore. The dashed line 470 runs vertically at the value of 0.25 (i.e., FF=0.25) between the approximate depths of 3,745.44 ft and 8,271.62 ft. At the depth of approximately 8,271.62 ft at a point 472, the dashed line 470 transitions to a dashed line 474. The dashed line 475 corresponds to planned or predicted FF values of 0.3 for drilling in the wellbore in open hole (e.g., uncased, unlined, etc.) conditions. The dashed line 474 runs vertically between the approximate depths of 8,271.62 ft and 13,795.93 ft, where the wellbore or drilling run terminates.

Determined values of FF are shown as points on the graph, where the points follow five general trendlines. Trendline 480 represents the FF for drilling in the cased wellbore. Drilling within a casing should not involve drilling formation, as a casing should separate the wellbore from the formation in a cased wellbore. The slope of trendline 480 indicates that the FF decreases with depth in the casing. A decreasing FF can be characteristic of improved drilling efficiency, such as due to increased WOB, drill string weight, etc. exerting downward pressure of the drill bit and drill string. Values of FF which are higher than predicted for drilling in the casing can be caused by defects in the casing, gauge size problems, etc.

Trendline 482 represents a group of FF values of approximately 1.5. The high values of FF at the transition between the cased wellbore and open hole drilling can be due to shoulders or unexpected transitions between the casing and the formation, due to collapsed formation, etc. Drilling parameters can be adjusted to bring FF in line with estimates or to increase drilling efficiency.

Trendline 484 represents a group of FF values of approximately 0.675. The value of FF below the transition between the cased wellbore and open hole drilling has decreased from the transition value of FF but is still higher than expected. The higher than predicted FF can correspond to drilling dysfunction or drill bit and cutter wear. The FF can also be a factor of misinformation about the formation—where the formation is harder than predicted, for example. Drilling parameters can be adjusted to bring FF in line with estimates or to increase drilling efficiency.

Trendline 486 represents a group of FF values increasing with depth between approximately 0.25 and 0.4. The increasing value of FF is characteristic of drill bit wear. As the drill bit is worn, the cutters can function less efficiency, drag can increase, and less drilling energy can be transformed into formation destruction. Drilling parameters are adjusted once again, but trendline 488 represents an additional group of FF values between 0.3 and 0.4 at a deeper depth. Adjusting drilling parameters can adjust the mean or median value of FF, but when drill bit wear is a factor (and when drill bit wear can be increasing) FF can trend higher as the drill bit becomes monotonically less efficiency or effective. Any other appropriate calculations of MSE or DE or related metrics can be used to determine measurements of efficiency.

At block 208, drill bit and cutter post-drilling characteristics are determined based on video analysis. For example, with reference to FIG. 1, the drill bit visual analyzer 150 can determine the drill bit and cutter post-drilling characteristics. At least a portion of the cutting surfaces of the drill bit can be recorded on video. In some implementations, all or substantially all of these cutting surfaces can be recorded. The volume of the drill bit can be measured or the video of the post-drilling drill bit can be stored for measurement of a difference between the pre-drilling drill bit and the post-drilling drill bit at block 210.

At block 210, drill bit and cutter wear are determined based on differences between the baseline and post-drilling drill bit and cutter characteristics. For example, with reference to FIG. 1, the drill bit wear processor 160 can determine the drill bit and cutter wear. The drill bit and cutter wear can be determined using a volumetric measurement of the pre-drilling drill bit and a volumetric measurement of the post-drilling drill bit. Alternatively, the drill bit and cutter wear can be determined by a visual analysis of the differences between the video of the pre-drilling drill bit and the video of the post-drilling drill bit. Any appropriate software, hardware, algorithm, etc. can be used to determine the difference between the pre-drilling drill bit and the post-drilling drill bit. The difference can be calculated for each cutter or cutting element of the drill bit, for regions of the drill bit, for the drill bit as a whole, etc. Statistical analysis of the drill bit and cutter wear can be performed in order to identify which portions of the drill bit and which cutter experiences the most wear and the least wear. The drill bit and cutter wear can be calculated as fractional bit wear $y_i$, a wear factor $W_f$, a change in bit grade ΔBG, using the IADC dull bit grading system, etc. Numerical evaluation of the drill bit and cutter wear can be interchangeable with qualitative evaluation, or quantitative evaluation (e.g., fractional bit wear $y_t$) can additionally be converted to IADC dull bit grading values or the like. Optionally, evenness of drill bit and cutter wear can be calculated based on a distribution of drill bit and cutter wear.

In some embodiments, types of drill bit and cutter wear can also be calculated. Types of drill bit and cutter wear can be identified through use of a standard deviation, distribution pattern identification, etc. For example, cutter wear may be uneven spatially with greater wear in one or more regions of the drill bit (such as inside the cone, outside the cone, etc.) or on one or more side of the drill bit. In another example, cutter wear may be discontinuous or unevenly distributed in severity—the majority of cutters can display minor or minimal wear with a significant minority of cutters displaying breakage or significant wear. Distribution of drill bit and cutter wear can be indicative of specific drilling or drill bit manufacturing dysfunctions. For example, a weak or faulty matrix can lead to lost cutters which may explain a pattern where the majority of cutters are minimally worn but other cutters are completely eroded or missing. In another example, significant wear on one side of a drill bit can correspond to an asymmetric drill string or BHA.

At block 214, it is determined if additional drill bit or drilling runs are available. For example, with reference to FIG. 1, the drill bit wear and drilling behavior modeler 180 can determine whether there are additional drill bit or drilling runs available can be made by. If there are additional available drilling runs for the currently selected drill bit or additional drill bits, operations return at block 202 where an additional drill bit and drilling run is selected. If there are no additional available drilling runs for the currently selected drill bit or for any additional drill bits, operations continue at block 216.

At block 216, drilling behavior and drill bit and cutter wear are related for drill bits and drilling runs. For example, with reference to FIG. 1, the drill bit wear and drilling behavior modeler 180 can relate the drilling behavior to drill bit and cutter wear. The relation between drilling behavior and drill bit and cutter wear can be a correlation, a relationship, a function, pattern recognition algorithm, etc. The relationship can be determined by point fitting, statistical analysis, graphical analysis, correlation of characteristic wear patterns and drilling events, etc. Alternatively (or additionally), the relationship between drilling behavior and drill bit and cutter wear can be determined by training one or more machine learning algorithm to predict drill bit and cutter wear based on drilling behavior and/or predict drilling behavior based on drill bit and cutter wear. Drilling behavior for an entire drilling run (i.e., accumulated over an entire drilling run) can be related to drill bit and cutter wear. Alternatively or in addition, specific drilling behavior events can be related to drill bit and cutter wear. Drilling events can include events of varying time lengths, such as a time period surrounding a substantially instantaneous change in drilling parameters or a longer time period during which a drilling dysfunction such as stick-slip is suspected or documented.

At block 218, a model of drill bit and cutter wear and drill bit behavior is generated based on the relationship between drilling behavior and drill bit and cutter wear. For example, with reference to FIG. 1, model of drill bit and cutter wear and drill bit behavior can be generated by the drill bit wear and drilling behavior modeler 180. The model can be a function of drilling behavior that outputs predicted drill bit and cutter wear. The model can be a function of drill bit and cutter wear that outputs predicted drilling behavior. The model can be both a forward model to predict drill bit and cutter wear and a backward model to predict drilling behavior, or two models together. The model can iteratively operate on both a forward model and a backward model, including operating to improve predictions based on observed behavior and wear. Alternatively (or additionally), the model can be a trained machine learning algorithm or machine-learning model which relates drill bit and cutter wear and drill bit behavior in one or more direction.

Example operations of using and updated the model generated by operations depicted in FIG. 2 are now described. In particular, FIG. 5 depicts a flowchart of example operations for using and updating the model of drill bit and cutter wear during drill operations, according to some embodiments. A flowchart 500 of FIG. 5 includes operations described as performed by the drill bit wear and drilling behavior modeler 180 for consistency with the earlier descriptions. Such operations can be performed by a controller or processor, hardware, firmware, software, or a combination thereof of one or more computers, including asynchronously. However, apparatus component naming, division, organization, and program code naming, organization, and deployment can vary due to arbitrary operation choice, ordering, programmer choice, programming language(s), platform, etc. Additionally, operations of the flowchart 500 are described in reference to the example apparatus 100 and the drill bit visual analyzer 150, the drill bit wear processor 160, the drill bit drilling behavior analyzer 170, and a drill bit wear and the drilling behavior modeler 180 of FIG. 1. The flowchart 500 includes the operations of blocks 502, 504, 508, 510, 512, 516, 518, 520, 522, 524, 526, and 528 described as performed by the drill bit wear and drilling behavior modeler 180. However, one or more of the operations described as being performed by the drill bit wear and drilling behavior modeler 180 may be performed by one or more of the drill bit visual analyzer 150, the drill bit wear processor 160, and the drill bit drilling behavior analyzer 170.

At block 502, drill bit and cutter baseline characteristics are determined based on video analysis. For example, with reference to FIG. 1, the drill bit visual analyzer 150 can determine the drill bit and cutter baseline characteristics prior to lowering the drill bit into the wellbore for drilling. For example, at least a portion of the cutting surfaces of the drill bit can be recorded on video. In some embodiments, all or substantially all of these cutting surfaces can be recorded on video. The drill bit visual analyzer 150 can then process the video to determine these baseline characteristics. Alternatively or in addition, the drill bit visual analyzer 150 can measure a volume of the drill bit prior to drilling to provide these baseline characteristics.

At block 503, hook load or other drilling attributes are measured during drilling. For example, with reference to FIG. 1, the drill bit drilling behavior analyzer can measure or determine the hook load values or values of other drilling attributes. The hook load can be measured directly from a scale, spring, at a block, etc. or can be detected or determined based on measurement of forces experiences at the drill string, hook, traveling block, etc. A drilling attribute other than hook load can be used alone or in combination to detect drilling forces, such as damping force, tension in the dead-line, block position, block velocity, drill string torque, drill string RPM, mud weight, etc.

At block 504, friction factor values or other measurements of drilling efficiency are determined based on hook load. For example, with reference to FIG. 1, the drill bit drilling behavior analyzer 170 can determine the friction factor values or other measurements of drilling efficiency. The friction factor can be calculated based on the hook load as described in reference to block 206 of FIG. 2, such as by using Eq. 6. Alternatively, MSE or another appropriate measure of drilling efficiency can be used, as previously described.

At block 506, drilling behavior is identified. For example, with reference to FIG. 1, the drill bit wear and drilling behavior modeler 180 can identify the drilling behavior. The drilling behavior also can be identified by a model output by the drill bit wear and drilling behavior modeler 180 and the drill bit and cutter wear can be predicted by a model output by the drill bit wear and drilling behavior modeler 180. Drilling behavior can be identified as a class of drilling behavior (e.g., as either functional or dysfunctional) or a specific type of drilling behavior can be identified. Drilling behavior types can include normal drilling, drilling with excess vibrations (including stick-slip drilling, backward whirl drilling, etc.), drilling with greater than expected wear (including high friction factor drilling, increasing friction factor drilling, etc.), etc. Drilling behavior can be identified or classified as any appropriately defined drilling behavior or drilling behavior type.

Example of drilling behavior can include an indication of whether the drilling is functional or dysfunctional. Drilling can be categorized as functional or dysfunctional based on values of various drilling parameters (including the measure of drilling efficiency). For example, the hook load can oscillate or switch between a static hook load (when the drill bit is not rotating), a kinetic hook load (when the drill bit is rotating), an off-bottom hook load (when the drill bit is not in contact with the bottom or end of the wellbore), etc. Oscillation between a static hook load and a kinetic hook load can be characteristic of a stick-slip drilling dysfunction. A stick-slip drilling dysfunction can also generate a bimodal distribution of the FF, where the FF varies between the static state and the rotating or kinetic state.

In order to reduce measurement induced error or to avoid identifying transient periods of dysfunctional drilling, a rolling average of the value of the measure of drilling efficiency can be used or the measure of drilling efficiency over a time window or range can be use or any other appropriate smoothing method. The measure of drilling efficiency can be compared to one or more threshold value to determine if the drilling behavior is dysfunctional. For a friction factor (FF) for example, dysfunctional drilling can be indicated when the FF is greater than 10% above the predicted FF for the location of the drill bit in the wellbore. The behavior of the measure of drilling efficiency in time can also be used to determine if dysfunctional drilling behavior is indicated. In another example, dysfunctional drilling can be indicated when FF is greater than 5% above the predicted FF for the location of the drill bit and when an average of the FF over a five-minute window rises for three or more sequential windows. In some implementations, the measure of drilling efficiency can be determined to correspond to dysfunctional drilling when the value exceeds a predicted value plus or minus a measurement uncertainly range. A rolling average of the measure of drilling efficiency (or other mean or median value) can be used instead of the measure of drilling efficiency itself, in order to smooth or remove measurement uncertainty. In some embodiments, a measure of distribution of the measure of drilling efficiency can also be considered—such as a standard deviation, a weighted average, etc.

At block 508, drill bit and cutter wear is predicted based on the model of the drill bit and based the drilling behavior. For example, with reference to FIG. 1, the drill bit and cutter wear can be predicted by the drill bit wear and drilling behavior modeler 180. Based on the identified drilling behavior or on the values of the measure of drilling efficiency, drill bit and cutter wear are predicted. The prediction can be an output of the model of drill bit and cutter wear and drilling behavior. The prediction can be iterative, where drill bit and cutter wear are predicted for an interval of drilling and further drill bit and cutter wear is predicted for a subsequent interval of drilling. The prediction can be cumulative, where drill bit and cutter wear are predicted based on the values of the measure of drilling efficiency or the changes in values of the measure of drilling efficiency over the entire drilling run. The prediction can be qualitative, such as the drill bit is predicted show radially asymmetric wear. The prediction can be quantitative, such as the cutter wear is predicted to be between 0.2 and 0.4 when calculated using the fractional bit wear $y_i$.

At block 510, a determination is made of whether the identified drilling behavior indicates dysfunctional drilling. For example, with reference to FIG. 1, the drill bit drilling behavior analyzer 170 or the drill bit wear and drilling behavior modeler 180 can determine if the measure of drilling efficiency values indicates dysfunctional drilling. Drilling behavior can be identified as either functional or dysfunction, where both functional and dysfunctional drilling behaviors are identified based on values of the measure of drilling efficiency. Alternatively, dysfunctional drilling behaviors can be identified or selected as a subset of all drilling behaviors by using values of the measure of drilling efficiency (i.e., in this case, functional drilling behaviors need not be identified specifically). In some embodiments, other drilling parameters can be used in addition to values of the measure of drilling efficiency in order to identify dysfunctional drilling behaviors—such as RPM, WOB, TOB, value of hook load, etc.

If the drilling behavior is identified as dysfunctional, operations continue at block 512. Otherwise, operations continue at block 516.

At block 512, drilling parameters are modified to mitigate the identified dysfunction. For example, with reference to FIG. 1, the drill bit drilling behavior analyzer 170, the drill bit wear and drilling behavior modeler 180 or a drilling controller or operator in communication with the drill bit drilling behavior analyzer 170 or the drill bit wear and drilling behavior modeler 180 can modify the drilling parameters. Drilling parameters such as RPM, TOB, WOB, drill collar weight, etc. can be modified to mitigate the identified dysfunction. Some types of drilling dysfunctions can correspond to characteristics drilling parameter or measure of efficiency behavior—such as stick-slip which can correspond to oscillation hook load, for example. Mitigation of dysfunctional drilling behavior can involve a general mitigation strategy, such as RPM reduction, WOB reduction, etc. General mitigation can involve reducing the energy introduced to the drilling operation through reduction of drilling forces, speed, etc., which can reduce induced or coupled vibrational and oscillatory modes. Mitigation of dysfunctional drilling behavior can additionally be tailored to the indicated dysfunction. For example, drill collar weight can be increased to reduce axial vibration of a drill string when a drill bit experiences bouncing off the bottom of the wellbore or significant off-bottom time.

Optionally, a determination can be made that a drilling dysfunction does not require mitigation or that mitigation is not favorable. In some embodiments, the identified drilling dysfunction can be a drilling dysfunction that does not correspond to drill bit and cutter wear or damage. For example, forward whirl (which is a type of dysfunctional drilling) may be non-destructive to the drill bit and cutters and may not affect ROP. In some embodiments, the identified drilling dysfunction may correspond to destructive drill bit and cutter wear, but mitigation can be financially or otherwise unfavorable. The predicted drill bit and cutter wear can be balanced against the total drilling time, total drilling depth, etc. to determine if mitigation is required or favorable. For example, in a wellbore approaching 13,400 feet (ft) in depth with a completion depth of 13,795 ft, mitigation of dysfunctional drilling behavior is balanced against the remaining drilling depth. A drill bit displaying dysfunctional drilling behavior may continue to be drilled, if mitigation is not possible or if mitigation strategies are exhausted, in order to drill the remaining 395 ft such that the drill string and drill bit do not have to be run out of the wellbore and another drill bit attached and run into the wellbore to complete the wellbore. Mitigation cost, in drilling time, in drilling materials—including cost incurred by damaged or worn materials and drill bits—etc., can be balanced against the effects of dysfunctional drilling.

At block 516, it is determined if drilling continues. For example, with reference to FIG. 1, the drill bit drilling behavior analyzer 170 can determine if drilling continues. The determination can be made based on received information about the value of the measures of drilling efficiency and/or based on output from a drilling controller or operation. The end of a drilling run, or any lifting of the drill string out of the wellbore, can terminate drilling. If drilling continues, operations continue at block 503 where hook load or other drilling attributes are measured. Otherwise, operations continue at block 518.

At block 518, drill bit and cutter post-drilling characteristics are determined based on video analysis. For example, with reference to FIG. 1, the drill bit visual analyzer 150 can determine the drill bit and cutter post-drilling characteristics. At least a portion of the cutting surfaces of the drill bit are recorded on video. The volume of the drill bit can be measured or the video of the post-drilling drill bit can be stored for measurement of a difference between the pre-drilling drill bit and the post-drilling drill bit at block 520.

At block 520, drill bit and cutter wear are determined based on differences between the baseline and post-drilling drill bit and cutter characteristics. For example, with reference to FIG. 1, the drill bit wear processor 160 can determine the drill bit and cutter wear. The drill bit and cutter wear can be determined using any appropriate method, such as those previously described in reference to block 210 of FIG. 2.

At block 522, a determination is made of whether the drill bit and cutter wear match the predicted drill bit and cutter wear. For example, with reference to FIG. 1, the drill bit wear processor 160 or the drill bit wear and drilling behavior modeler 180 can predict the drill bit and cutter post-drilling wear and can compare the measured drill bit and cutter wear and the predicted drill bit and cutter wear. The measured drill bit and cutter wear can be determined from the difference between the drill bit and cutter baseline characteristics and the drill bit and cutter post-drilling characteristics and their video analysis. This measured drill bit and cutter wear can be compared to the predicted drill bit and cutter wear, which is based on the output of the model of drill bit and cutter wear and drilling behavior. The determination whether the measure and predicted drill bit and cutter wear match can be based on a difference or agreement between the measured and predicted drill bit and cutter wear. For example, if the predicted drill bit and cutter wear is a numerical value, the measured drill bit and cutter wear can be compared numerically, can be compared against the predicted value plus or minus an agreement threshold, can be compared to a range of predicted numerical values, etc. In another example if the predicted drill bit and cutter wear is a representation of the drill bit and cutters, the predicted and measure drill bit and cutter wear can be represented as a 3D union, intersection, set difference, etc. of points or vectors of the 3D representation. The predicted drill bit and cutter wear can also be compared qualitatively with the predicted drill bit and cutter wear, such that an operator or program can generally compare the predicted and measured drill bit and cutter wear to determine if they match or not. If the drill bit and cutter wear match the predicted wear, operations continue at block 524. Otherwise, operations continue at block 526.

At block 524, the model of drill bit wear and drilling behavior is updated, optionally. If the predicted drill bit and cutter wear matches the measured drill bit and cutter wear, then the model may or may not be updated based on the drilling run. For example, with reference to FIG. 1, the drill bit wear and drilling behavior modeler 180 can update the model of drill bit wear and drilling behavior. The drilling run and drill bit can be added to the set of drilling runs comprising the model, or set of drilling runs comprising the training data for the model or machine learning algorithm. In some embodiments, the model can be updated with additional data. In some embodiments, if the model is in agreement with drilling data, the model may or may not be updated with additional data.

At block 526, it is determined if the drill bit and cutter wear is explained by other drilling factors. For example, with reference to FIG. 1, the drill bit wear and drilling behavior modeler 180 can make this determination. If the predicted drill bit and cutter wear and the measured drill bit and cutter wear do not match or are not in agreement, additional drilling parameters can be analyzed to determine if drill bit and cutter wear is otherwise explained. Drill bit and cutter wear may be smaller than predicted. For example, if the measure of drilling efficiency indicates that dysfunctional drilling is occurring, but the drill bit and cutter wear is minimal, drilling dysfunction could be explained by a narrower than expected wellbore. In such a case, a previous drill bit could have experienced gauge erosion or other factors, such that the wellbore which is expected to be 8" in diameter is instead 7.75" in diameter. This would result in additional drilling energy requirements and reduce ROP in a subsequent run, but could also result in minimal or normal wear on the cutters of the subsequent drill bit.

Drill bit and cutter wear may instead be larger than predicted. For example, measures of drilling efficiency might not indicate that drilling dysfunction occurred, but the drill bit and cutters could exhibit significant wear or damage. Such a result could be explained by occurrence of a type of drilling dysfunction that was not detected in the measure of drilling efficiency. Such a result could also be explained by damage to the drill bit and/or cutters while the drill string was removed from the wellbore after drilling, such as collision with a casing or shoulder as the drill bit was pulled upwards. In a third case, such a result could be explained by two offsetting effects occurring at the same time—such as if a drilling dysfunction such as backward whirl (which reduces drilling efficiency) occurred in a formation which was softer than expected (which should increase drilling efficiency). Drilling involves many factors, not all of which are measurable at the surface. Drill bit and cutter wear may be explainable based on additional drilling knowledge or characteristic patterns.

At block 528, the model of drill bit wear and drilling behavior is updated. If the predicted drill bit and cutter wear does not match the measured drill bit and cutter wear and the drill bit and cutter wear is not explained by other drilling factors, then the model can be updated based on the drilling run. For example, with reference to FIG. 1, the drill bit wear and drilling behavior modeler 180 can update the model of drill bit wear and drilling behavior. The drilling run and drill bit can be added to the set of drilling runs comprising the model, or set of drilling runs comprising the training data for the model or machine learning algorithm. Optionally, a new model can be trained or created.

Drill Bit and Cutter Wear Examples

Examples of the wear of drill bits and the wear of cutters on drill bits that are a result of drilling are now described. FIGS. 6A-6B, 7A-7B, and 8A-8B depict example evidence of drill bit and cutter wear both before and after use during drilling from a video analysis of wear, performed according to some embodiments. FIGS. 6A-6B, 7A-7B, and 8A-8B show, as line drawings, example still frames from video taken of drill bits before and after drilling. For example, with reference to FIG. 1, the video can be captured by the drill bit visual analyzer 150 and analyzed by the drill bit wear processor 160. The drill bits shown are PDC drill bits, but analysis can occur on any type of drill bit and on any type of cutter and any type of drill surface. Portions of the drill bit are depicted in line drawings 600, 650, 700, 750, 800, 850 in FIGS. 6A-6B, 7A-7B, and 8A-8B, respectively. A video of the drill bit can capture at least a portion of the cutting surfaces of the drill bit for analysis. In some embodiments, the video of the drill bit can capture substantially all the cutting surfaces. However, no one frame of the video is required to capture substantially all cutting surface of the drill bit. The use of video with a multitude of image frames allows capture of images of substantially all cutting surfaces without imposing image collection requirements for a single image on the videographer or drill bit visual analyzer 150. Further, the drill bit and cutter wear can be (e.g., the pre-drilling bit wear 162 and the post-drilling bit wear 164) measured even if the frames do not capture the same area of the drill bit or capture images in the same or a similar order. The line drawings 600, 650, 700, 750, 800, 850 are depicted as displaying different areas of the drill bits, from different angles, and with different drill bit orientations, as can be present in the recorded video. For simplicity, drill wear images have been combined to show multiple types of drill bit and cutter wear. It should be understood that drill bit and cutter wear can include all, some, or none of the types of drill bit and cutter wear shown and can display wear types not depicted in these example images.

Figure 6B:
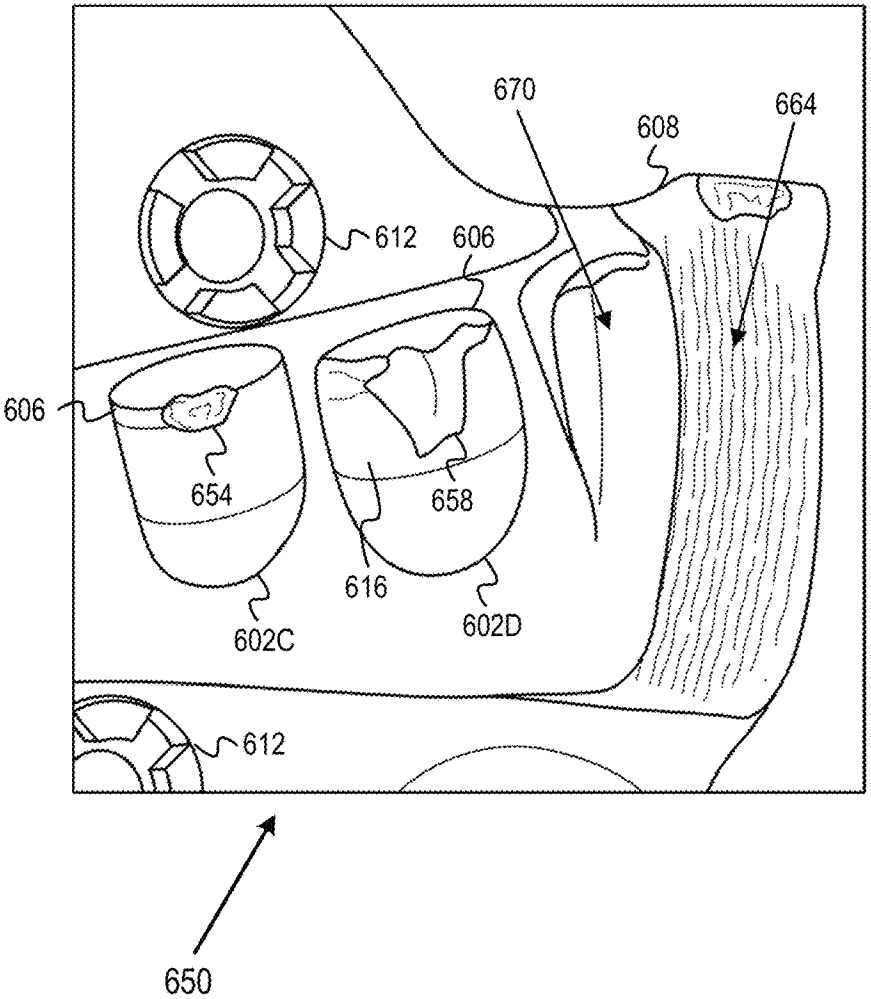
FIGS. 6A-6B, 7A-7B, and 8A-8B depict example evidence of drill bit and cutter wear both before and after use during drilling from a video analysis of wear, performed according to some embodiments.
Figure 6A:
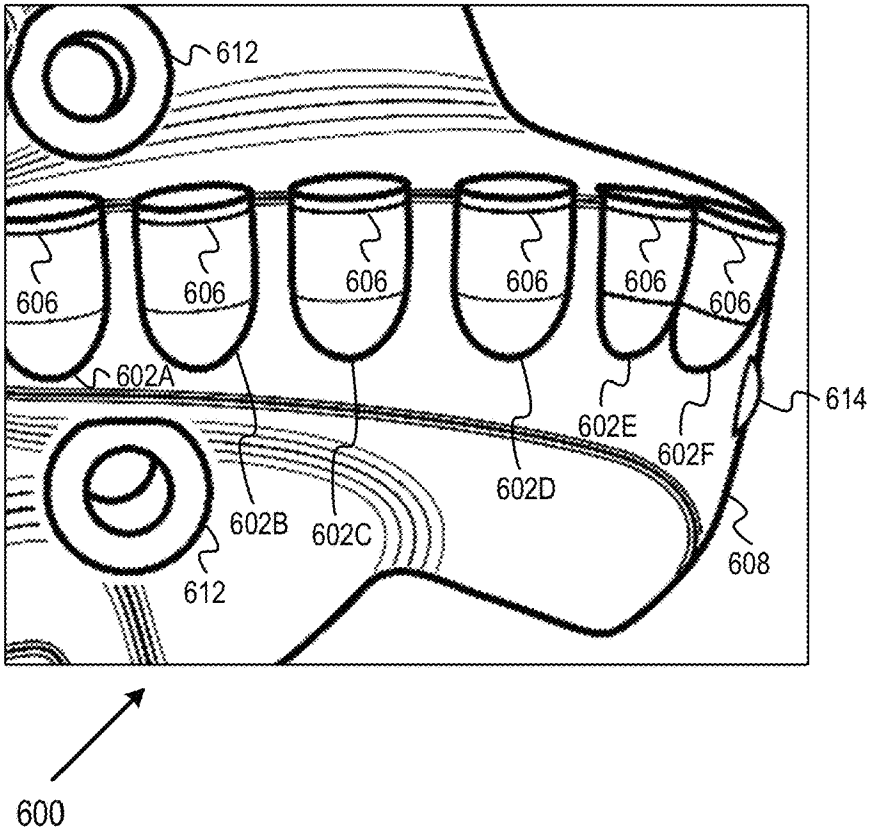

FIG. 6A depicts the line drawing 600 of portions of an example PDC drill bit. The line drawing 600 shows multiple cutters (cutters 602A-602F) and modified diamond reinforced (MDR) cutter 614, on a blade 608, and multiple nozzles 612. The cutters 602 are relatively unworn, where each of the cutters 602A-602F has a diamond layer 606 which is intact. The line drawing 600 can correspond to a new or as-manufactured drill bit, or a lightly worn drill bit.

FIG. 6B depicts the line drawing 650 of portions of the example PDC drill bit of FIG. 6A after drilling. The line drawing 650 depicts the wear on the cutters 602C and 602D on the blade 608, and the multiple nozzles 612. The cutter 602C is lightly worn with damage 654 to the diamond layer 606. The cutter 602D is worn, with damage 658. The damage 658 is evident in both the diamond layer 606 and a tungsten carbide layer 616. The damage 658 can be caused by wear, possibly by heat check, by severe impacts, etc. An area 670 corresponds to a missing cutter (i.e., a cutter where the damage is so severe that it has detached from the drill bit) which is the cutter 602E of FIG. 6A. The end of the blade 608 also displays a ring out area 664. Ring out can be caused by rotational damage to a portion of the drill bit and can result from or cause loss of cutters (like the area 670), and cause damage to the matrix or steel body of the drill bit, damage to the blade 660, etc. Ring out is depicted here at the shoulder of the drill bit, but should be understood to occur in any region of the drill bit. The ring out area 664 corresponds to the loss of cutters 602F and MDR cutter 614 of FIG. 6A.

Figure 7B:
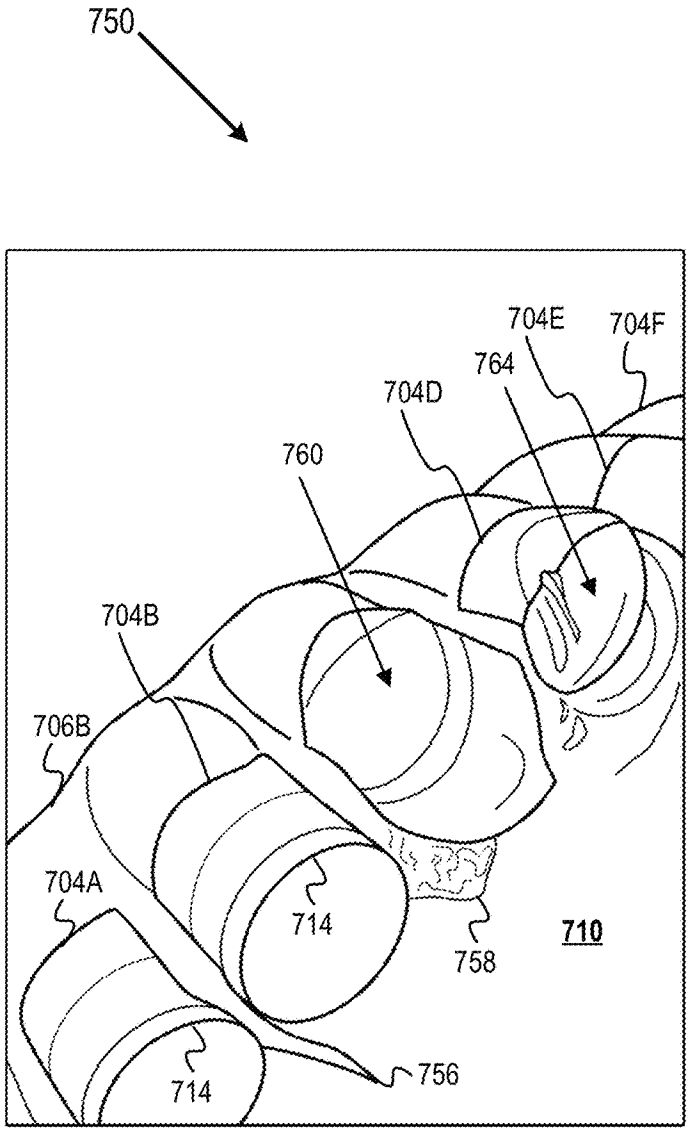
Figure 7A:
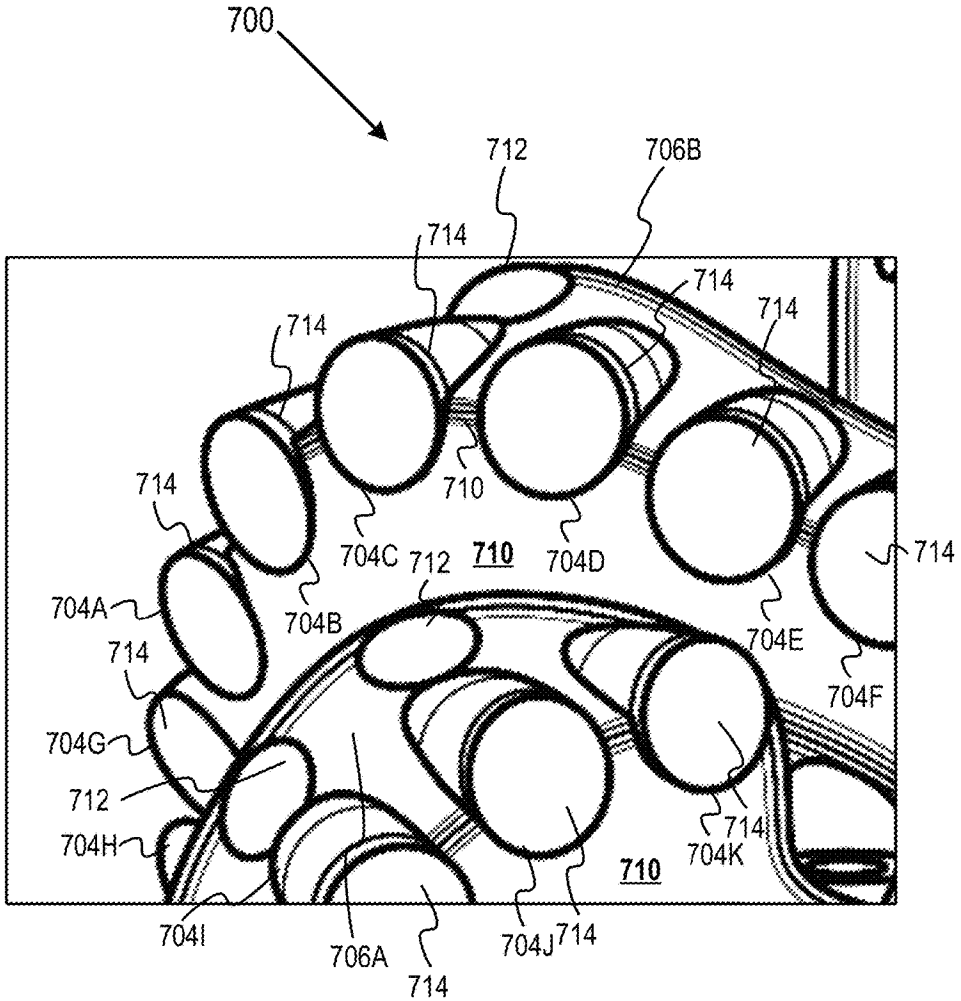

FIG. 7A depicts the line drawing 700 of portions of an example PDC drill bit. The line drawing 700 shows multiple cutters 704A-704K, on blades 706A-706B, and MDR cutters 712. The cutters are embedded in matrix material 710, which is intact. The cutters 704A-704K and MDR cutters 712 are relatively unworn—each of the cutters 704A-704K has a diamond layer 714 which is intact. The line drawing 700 can correspond to a new or as-manufactured drill bit, or a lightly worn drill bit.

FIG. 7B depicts the line drawing 750 of portions of the example PDC drill bit of FIG. 7A after drilling. The line drawing 750 depicts wear on the cutters 704A and 704B with diamond layers 714 (which are intact) on the blade 706B of the PDC bit. The cutters are embedded in the matrix material 710, which displays erosion in damaged areas 756 (between the cutters 704A and 704B) and 758 (next to the cutter 704B). An area 760 corresponds to a missing cutter, where the cutter 704C was previously attached to the blade 706B. An area 764 corresponds to the cutter 704D with bond failure where the diamond layer and tungsten carbide layer are missing. Bond failure can be a manufacturing defect. Missing cutters and matrix erosion can be cause by abrasive or incorrectly chosen drilling mud, by manufacturing defects, etc. The view of the line drawing 750 is such that no MDR cutters 712 are visible in the frame.

Figure 8B:
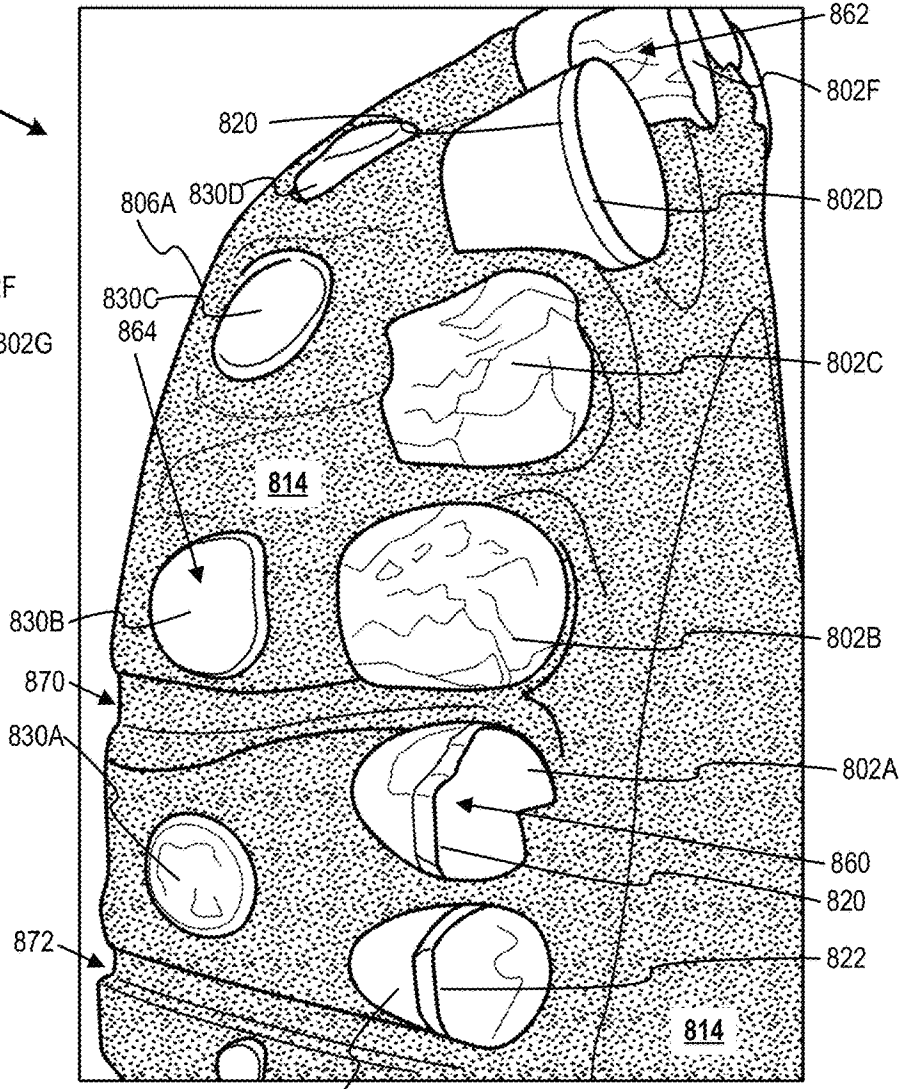
Figure 8A:
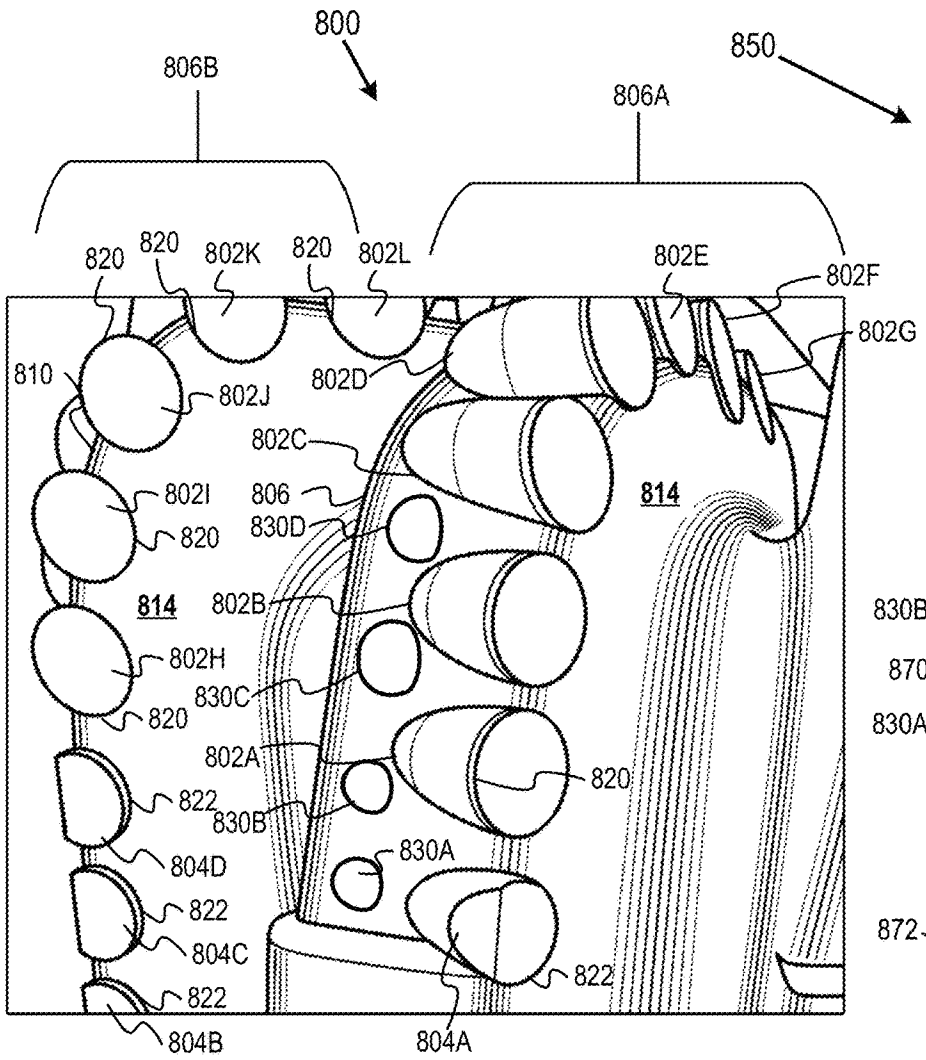

FIG. 8A depicts the line drawing 800 of portions of an example PDC drill bit. The line drawing 800 shows full cutters 802A-802L, gauge cutters 804A-804D, and MDR cutters 830A-830D on blades 806A and 806B. The cutters (i.e., the full cutters 802A-802L, the gauge cutters 804A-804D, and the MDR cutters 830A-830D) are embedded in matrix material 814, which is intact. The full cutters 802A-802L, the gauge cutters 804A-804D and MDR cutters 830A-830C are relatively unworn—each of the full cutters 802A-802L has a diamond layer 820 which is intact. The gauge cutters 804A-804D have diamond layers 822 which is intact, which can be less than round or less than a full sphere even in the unworn condition. The line drawing 800 can correspond to a new or as-manufactured drill bit, or a lightly worn drill bit.

FIG. 8B depicts the line drawing 850 of portions of the example PDC drill bit of FIG. 8A after drilling. The line drawing 850 shows the full cutters 802A-802F, the gauge cutter 804A, and the MDR cutters 830A-830D on the blade 806A of the PDC bit. The MDR cutters 830A-830D display wear, where they are substantially flatter than unworn MDR cutters. The MDR cutter 830B displays damaged area 864, where the dome of the MDR cutter is truncated. The damaged area 864 can be caused by normal wear, by undersize gauge on a previous drilling run, by abrasive formation cuttings, etc. The cutter 802D is relatively unworn, with a diamond layer 820 which is intact. The cutter 802A displays a damaged area 860, where damage to the diamond layer 820 and to the cutter underneath is evident. The cutters 802D and 802C are damaged to the extent that the diamond layer 822 of each cutter is completely worn away. The cutter 802F displays a damaged area 862, where of portion of the cutter side wall has sheared away damaging the diamond layer. The gauge cutter 804A displays wear on the diamond layer 822, which—as seen in FIG. 8A—is not a full circle even in the unworn state. The diamond layer 822 displays some wear, but the angled cut to the diamond layer can be representative of the gauge cutter as manufactured and not caused by wear. The cutters are embedded in matrix material, which displays erosion in damaged areas 870 and 872 and overall surface pitting as shown by the texture of the matrix material 814. Matrix erosion and surface pitting can be caused by causing drilling mud, reactive formation cuttings, etc.

For each of the drill bits represented by the example figures, drill bit and cutter wear can be calculated using any appropriate method, such as fractional bit wear $y_i$, a wear factor $W_f$, a change in bit grade ΔBG, using the IADC dull bit grading system, etc. For example, using the fraction bit wear $y_i$ calculation of Eq. 1, the cutter 602D with the damaged 658 of FIG. 6B can correspond to a dull bit or fractional bit wear value of 0.75. In another example, using the fraction bit wear $y_i$ calculation of Eq. 1, the area represented by the cutters 704A-704B and 704C and the areas 760 and 762 of FIG. 7B can correspond to a dull bit or fractional bit wear value of 0.56. In a third example, using the fraction bit wear $y_i$ calculation of Eq. 1, the surface represented by the texture of the matrix material 814 of FIG. 8B can correspond to a dull bit or fractional bit wear value of 0.53. Unworn drill bits and cutters can correspond to a dull bit or fractional bit wear value of 0 (zero). These are example values, and can vary based on the area selected for measurement, the wear, the calculation method, etc.

Example Drilling Application

Figure 9:
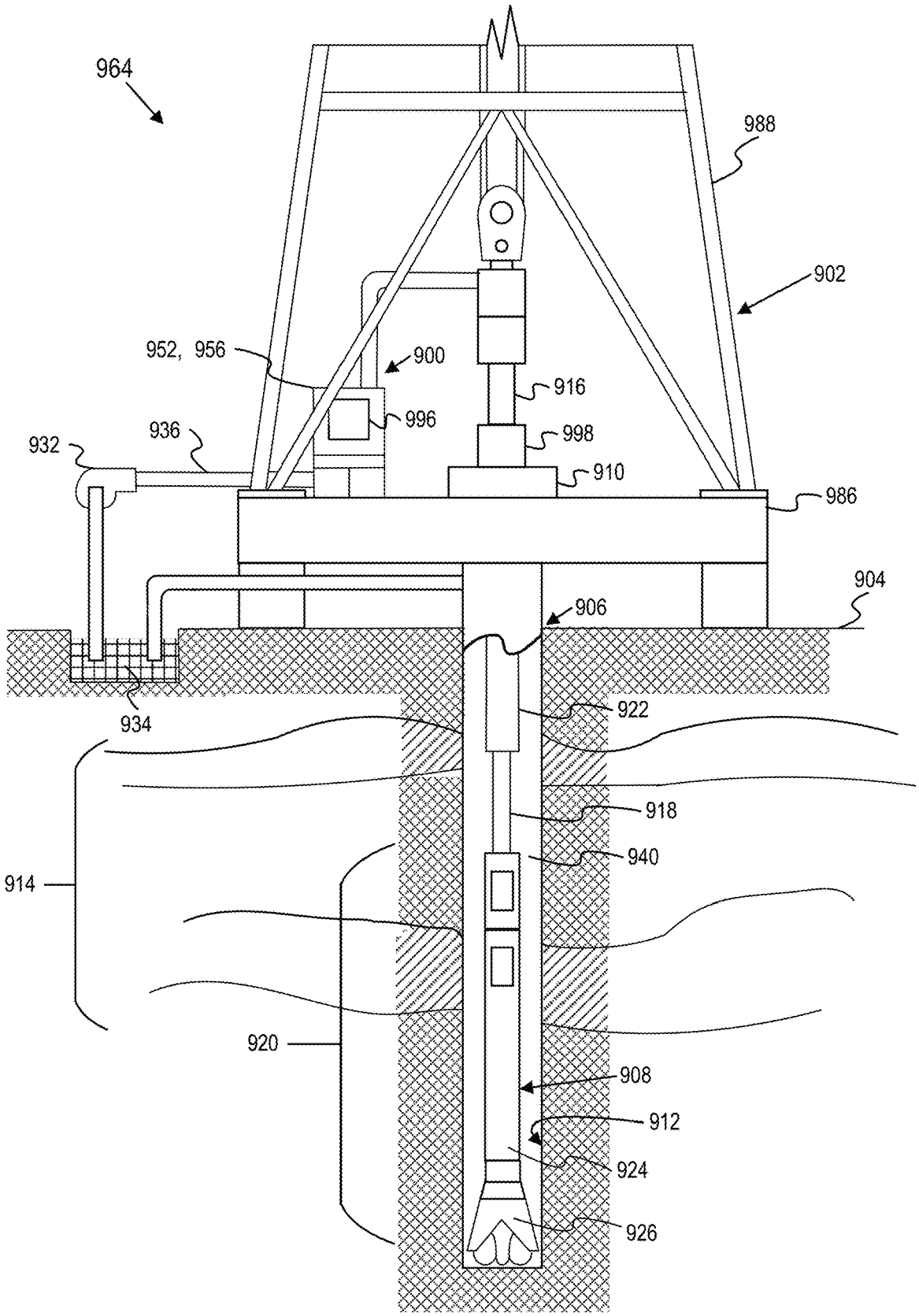
FIG. 9 depicts a schematic diagram of an example drilling rig system, according to some embodiments.

FIG. 9 depicts a schematic diagram of an example drilling rig system, according to some embodiments. For example, in FIG. 9 it can be seen how a system 964 may also form a portion of a drilling rig 902 located at the surface 904 of a well 906. The surface 904 may also be a subsea surface, or a floating surface such as above an ocean where the well 906 is a subsea well. Drilling of oil and gas wells is commonly carried out using a string of drill pipes connected together so as to form a drilling string 908 that is lowered through a rotary table 910 into a wellbore or borehole 912. Here a drilling platform 986 is equipped with a derrick 988 that supports a hoist. The hoist can include a traveling block, hook, etc. as previously described. The derrick 988 can include a spring, scale, or other equipment to measure hook load, as previously described.

The drilling rig 902 may thus provide support for the drill string 908. The drill string 908 may operate to penetrate the rotary table 910 for drilling the borehole 912 through subsurface formations 914. The drill string 908 may include a Kelly 916, drill pipe 918, and a bottom hole assembly 920, perhaps located at the lower portion of the drill pipe 918.

The bottom hole assembly 920 may include drill collars 922, a down hole tool 924, and a drill bit 926. The drill bit 926 may operate to create a borehole 912 by penetrating the surface 904 and subsurface formations 914. The down hole tool 924 may comprise any of a number of different types of tools including MWD tools, LWD tools, and others.

During drilling operations, the drill string 908 (perhaps including the Kelly 916, the drill pipe 918, and the bottom hole assembly 920) may be rotated by the rotary table 910. In addition to, or alternatively, the bottom hole assembly 920 may also be rotated by a motor (e.g., a mud motor) that is located down hole. The drill collars 922 may be used to add weight to the drill bit 926. The drill collars 922 may also operate to stiffen the bottom hole assembly 920, allowing the bottom hole assembly 920 to transfer the added weight to the drill bit 926, and in turn, to assist the drill bit 126 in penetrating the surface 904 and subsurface formations 914.

During drilling operations, a mud pump 932 may pump drilling fluid (sometimes known by those of ordinary skill in the art as "drilling mud") from a mud pit 934 through a hose 936 into the drill pipe 918 and down to the drill bit 926. The drilling fluid can flow out from the drill bit 926 and be returned to the surface 904 through an annular area 940 between the drill pipe 918 and the sides of the borehole 912. The drilling fluid may then be returned to the mud pit 934, where such fluid is filtered. In some embodiments, the drilling fluid can be used to cool the drill bit 926, as well as to provide lubrication for the drill bit 926 during drilling operations. Additionally, the drilling fluid may be used to remove subsurface formation 914 cuttings created by operating the drill bit 926. It is the images of these cuttings that many embodiments operate to acquire and process.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. For example, the operations depicted in blocks 208 and 210 can be performed in parallel or concurrently. With respect to FIG. 5, a model update is not necessary. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain, or store a program for use by or in connection with an instruction execution system, apparatus, or device. A machine-readable storage medium is not a machine-readable signal medium.

A machine-readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

Example Computer

Figure 10:
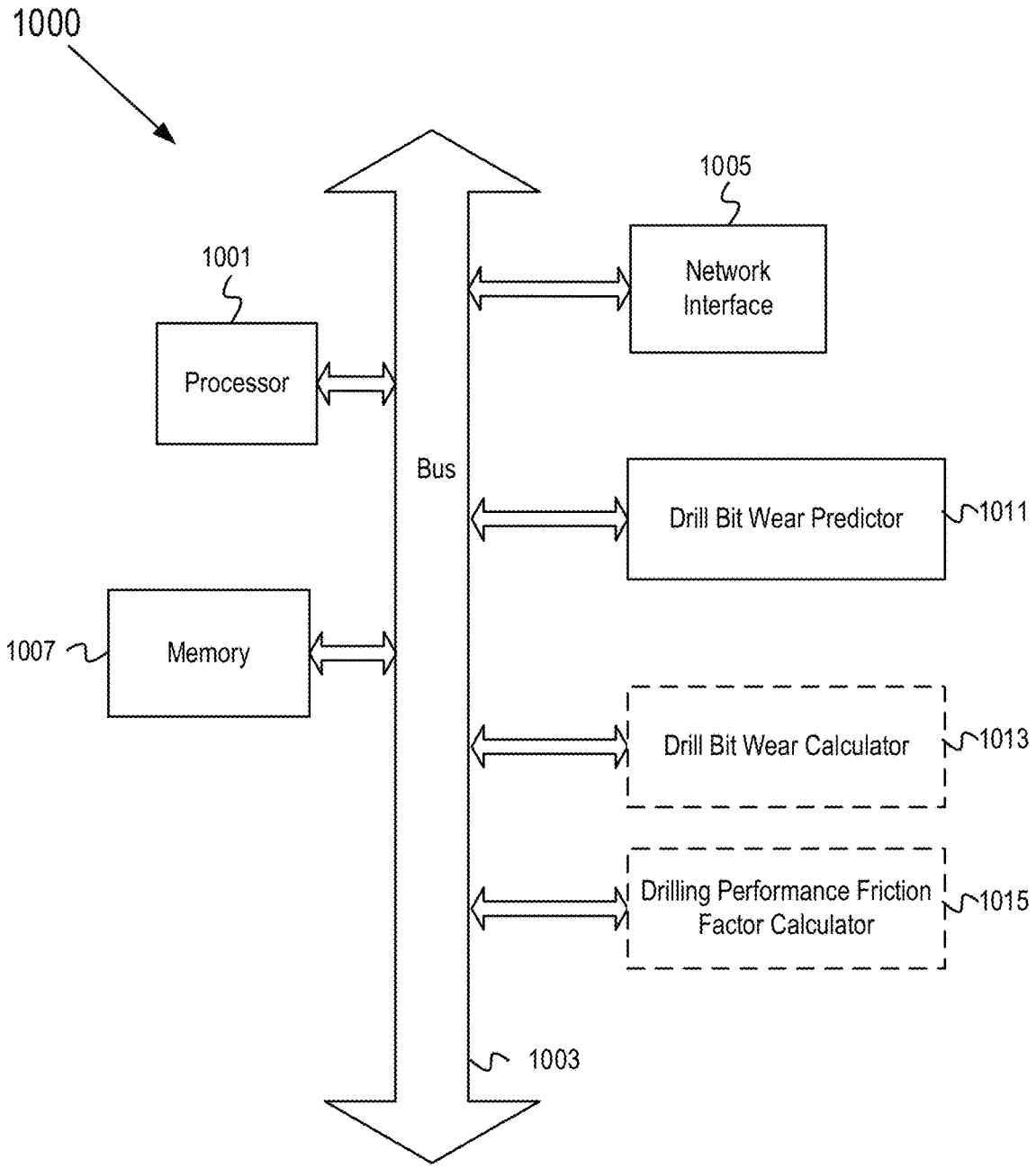
FIG. 10 depicts an example computer, according to some embodiments.

FIG. 10 depicts an example computer, according to some embodiments. A computer 1000 includes a processor 1001 (possibly including multiple processors, multiple cores, multiple nodes, and/or implementing multi-threading, etc.). The computer 1000 includes a memory 1007. The memory 1007 may be system memory or any one or more of the above already described possible realizations of machine-readable media. The computer 1000 also includes a bus 1003 and a network interface 1005. The system also includes a drill bit wear predictor 1011. The drill bit wear predictor 1011 can perform the example operations for predicting drill bit wear (as described above). Any one of the previously described functionalities may be partially (or entirely) implemented in hardware and/or on the processor 1001. For example, the functionality may be implemented with an application specific integrated circuit, in logic implemented in the processor 1001, in a co-processor on a peripheral device or card, etc. The computer 1000 optionally includes a drill bit wear calculator 1013 and a drilling performance friction factor calculator 1015. The drill bit wear calculator 1013 and the drilling performance friction factor calculator 1015 can be elements or sub-components of the drill bit wear predictor 1011 or in communication with the drill bit wear predictor 1011. Further, realizations may include fewer or additional components not illustrated in FIG. 10 (e.g., video cards, audio cards, additional network interfaces, peripheral devices, etc.). The processor 1001 and the network interface 1005 are coupled to the bus 1003. Although illustrated as being coupled to the bus 1003, the memory 1007 may be coupled to the processor 1001.

While the aspects of the disclosure are described with reference to various implementations and exploitations, it will be understood that these aspects are illustrative and that the scope of the claims is not limited to them. In general, techniques for drill bit wear and drill bit behavior modeling as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Example Embodiments

Embodiment 1: A method comprising: detecting, during a current drilling operation of a wellbore using a current drill bit, at least one drilling attribute; determining a measure of drilling efficiency of the current drill bit based on the at least one drilling attribute; performing video analytics of at least one video that includes at least a portion of a view of wear surfaces of the current drill bit; determining a drill bit wear of the current drill bit based on the video analytics; and modifying the current drilling operation based on the measure of drilling efficiency, the drill bit wear and a drill bit wear model that defines a relationship between the measure of drilling efficiency and the drill bit wear.

Embodiment 2: The method of embodiment 1, further comprising: updating the drill bit wear model based on the measure of drilling efficiency and the drill bit wear.

Embodiment 3: The method of embodiment 1 or 2, wherein the drill bit wear model is generated from at least one prior drilling operation.

Embodiment 4: The method of any one of embodiments 1 to 3, further comprising: determining a cause of the drill bit wear of the current drill bit that is a result of the current drilling operation of the wellbore, wherein determining the cause of the drill bit wear is based on the measure of drilling efficiency, the drill bit wear and the drill bit wear model.

Embodiment 5: The method of embodiment 4, further comprising modifying a subsequent drilling operation of the wellbore based on the cause of the drill bit wear.

Embodiment 6: The method of embodiment 5, wherein modifying the subsequent drilling operation comprises changing a value of at least one drilling parameter of a subsequent drilling of the wellbore in comparison to the value of the at least one drilling parameter used in the current drilling operation.

Embodiment 7: The method of embodiment 5, wherein the current drill bit has at least one attribute, wherein modifying the subsequent drilling operation comprises selecting a different drill bit having at least one attribute that is different than the at least one attribute of the current drill bit.

Embodiment 8: The method of any one of embodiments 1 to 7, wherein determining the drill bit wear comprises determining a wear of at least one cutter of the current drill bit, and wherein determining the wear of at least one cutter comprises determining the wear of the at least one cutter based on a geometric correlation between at least one of a height loss and volume loss of the at least one cutter that is a result of the current drilling operation.

Embodiment 9: The method of any one of embodiments 1 to 8, wherein the measure of drilling efficiency comprises a friction factor.

Embodiment 10: The method of any one of embodiments 1 to 8, wherein the measure of drilling efficiency comprises mechanical specific energy.

Embodiment 11: The method of any one of embodiments 1 to 10, wherein performing the video analytics of the at least one video comprises: processing a post-drilling video of the at least one video of the drill bit after drilling of the wellbore using the current drill bit; and determining the drill bit wear of the current drill bit that is a result of drilling the wellbore based on the post-drilling video.

Embodiment 12: The method of embodiment 11, wherein performing the video analytics of the at least one video further comprises: processing a pre-drilling video of the at least one video of the current drill bit prior to drilling of the wellbore using the current drill bit, and wherein determining the drill bit wear of the current drill bit that is the result of drilling the wellbore based on the post-drilling video comprises determining the drill bit wear of the current drill bit based on a comparison of the pre-drilling video to the post-drilling video.

Embodiment 13: A system comprising: a drill string having a drill bit to drill a wellbore; a sensor to detect, during drilling of the wellbore using the drill string, at least one drilling attribute; a processor; and a computer-readable medium having instructions thereon that are executable by the processor to cause the system to: determine a measure of drilling efficiency of the drill bit based on the at least one drilling attribute; perform video analytics of at least one video that includes at least a portion of a view of wear surfaces of the drill bit; determine a drill bit wear of the drill bit based on the video analytics; determine a relationship between the measure of drilling efficiency with the drill bit wear of the drill bit; and generate a drill bit wear model that is derived from the relationship between the measure of drilling efficiency and the drill bit wear.

Embodiment 14: The system of embodiment 13, wherein the instructions executable by the processor to cause the system to generate the drill bit wear model comprises instructions executable by the processor to cause the system to: identify a dysfunctional instance of drilling behavior based on the measure of drilling efficiency; identify a drill bit wear characteristic associated with the dysfunctional instance of drilling behavior; and generate the drill bit wear model that is derived from a relationship between the dysfunctional instance of drilling behavior and the drill bit wear characteristic.

Embodiment 15: The system of embodiment 13 or 14, wherein the instructions comprise instructions executable by the processor to cause the system to: predict drill bit wear for drilling a different wellbore based on the drill bit wear model.

Embodiment 16: The system of embodiment 15, wherein the instructions comprise instructions executable by the processor to cause the system to: mitigate drill bit wear for drilling the different wellbore based on the drill bit wear model and the predicted drill bit wear.

Embodiment 17: A non-transitory, machine-readable medium having instructions stored thereon that are executable by a computing device to perform operations comprising: detecting, during a current drilling operation of a wellbore using a current drill bit, at least one drilling attribute; determining a measure of drilling efficiency of the current drill bit based on the at least one drilling attribute; performing video analytics of at least one video that includes at least a portion of a view of wear surfaces of the current drill bit; determining a drill bit wear of the current drill bit based on the video analytics; and modifying the current drilling operation based on the measure of drilling efficiency, the drill bit wear and a drill bit wear model that defines a relationship between the measure of drilling efficiency and the drill bit wear.

Embodiment 18: The non-transitory, machine-readable medium of embodiment 17, wherein the instructions further comprise instructions executable by the computing device to perform operations comprising: updating the drill bit wear model based on the measure of drilling efficiency and the drill bit wear, wherein the drill bit wear model is generated from at least one prior drilling operation; and determining a cause of the drill bit wear of the current drill bit that is a result of the current drilling operation of the wellbore, wherein determining the cause of the drill bit wear is based on the measure of drilling efficiency, the drill bit wear and the drill bit wear model.

Embodiment 19: The non-transitory, machine-readable medium of embodiment 18, wherein the instructions further comprise instructions executable by the computing device to perform operations comprising: modifying a subsequent drilling operation of the wellbore based on the cause of the drill bit wear, wherein the instructions executable by the computing device to perform operations comprising modifying the subsequent drilling operation further comprise instructions executable by the computing device to perform operations comprising at least one of: changing a value of at least one drilling parameter of a subsequent drilling of the wellbore in comparison to the value of the at least one drilling parameter used in the current drilling operation; and selecting a different drill bit having at least one attribute that is different than the at least one attribute of the current drill bit.

Embodiment 20: The non-transitory, machine-readable medium of any one of embodiments 17 to 19, wherein the instructions stored thereon that are executable by the computing device to perform operations comprising performing the video analytics of the at least one video further comprise instructions executable by the computing device to perform operations comprising: processing a pre-drilling video of the at least one video of the current drill bit prior to drilling of the wellbore using the current drill bit, processing a post-drilling video of the at least one video of the current drill bit prior to drilling of the wellbore using the current drill bit, and wherein determining the drill bit wear of the current drill bit that is a result of drilling the wellbore based on the post-drilling video comprises determining the drill bit wear of the current drill bit based on a comparison of the pre-drilling video to the post-drilling video.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

What is claimed is:

1. A method comprising:

detecting, during a current drilling operation of a wellbore using a current drill bit, at least one drilling attribute;

determining a measure of drilling efficiency of the current drill bit based on the at least one drilling attribute, wherein the measure of drilling efficiency is based on at least one of friction factor and a mechanical specific energy (MSE);

performing video analytics of at least one video that includes at least a portion of a view of wear surfaces of the current drill bit;

determining a drill bit wear of the current drill bit based on the video analytics;

generating a drill bit wear model that defines a relationship between the measure of drilling efficiency and the drill bit wear based on the video analytics; and modifying the current drilling operation based on the measure of drilling efficiency, the drill bit wear and the drill bit wear model.

2. The method of claim 1, further comprising:

updating the drill bit wear model based on the measure of drilling efficiency and the drill bit wear based on the video analytics.

3. The method of claim 1, wherein the drill bit wear model is generated from at least one prior drilling operation.

4. The method of claim 1, further comprising:

determining a cause of the drill bit wear of the current drill bit that is a result of the current drilling operation of the wellbore, wherein determining the cause of the drill bit wear is based on the measure of drilling efficiency, the drill bit wear and the drill bit wear model.

5. The method of claim 4, further comprising modifying a subsequent drilling operation of the wellbore based on the cause of the drill bit wear.

6. The method of claim 5, wherein modifying the subsequent drilling operation comprises changing a value of at least one drilling parameter of a subsequent drilling of the wellbore in comparison to the value of the at least one drilling parameter used in the current drilling operation.

7. The method of claim 5, wherein the current drill bit has at least one attribute, wherein modifying the subsequent drilling operation comprises selecting a different drill bit having at least one attribute that is different than the at least one attribute of the current drill bit.

8. The method of claim 1, wherein determining the drill bit wear comprises determining a wear of at least one cutter of the current drill bit, and wherein determining the wear of at least one cutter comprises determining the wear of the at least one cutter based on a geometric correlation between at least one of a height loss and volume loss of the at least one cutter that is a result of the current drilling operation.

9. The method of claim 1, wherein the at least one drilling attribute used in determining the measure of drilling efficiency is hook load.

10. The method of claim 1, wherein the measure of drilling efficiency can be calculated based on hook load and a comparison of actual hook load and a predicted load.

11. The method of claim 1, wherein performing the video analytics of the at least one video comprises:

processing a post-drilling video of the at least one video of the drill bit after drilling of the wellbore using the current drill bit; and determining the drill bit wear of the current drill bit that is a result of drilling the wellbore based on the post-drilling video.

12. The method of claim 11, wherein performing the video analytics of the at least one video further comprises:

processing a pre-drilling video of the at least one video of the current drill bit prior to drilling of the wellbore using the current drill bit, and wherein determining the drill bit wear of the current drill bit that is the result of drilling the wellbore based on the post-drilling video comprises determining the drill bit wear of the current drill bit based on a comparison of the pre-drilling video to the post-drilling video.

13. A system comprising:

a drill string having a drill bit to drill a wellbore;

a sensor to detect, during drilling of the wellbore using the drill string, at least one drilling attribute;

a processor; and a computer-readable medium having instructions thereon that are executable by the processor to cause the system to:

determine a measure of drilling efficiency of the drill bit based on the at least one drilling attribute, wherein the measure of drilling efficiency is based on at least one of friction factor and a mechanical specific energy (MSE);

perform video analytics of at least one video that includes at least a portion of a view of wear surfaces of the drill bit;

determine a drill bit wear of the drill bit based on the video analytics;

determine a relationship between the measure of drilling efficiency with the drill bit wear of the drill bit; and generate a drill bit wear model based on the relationship between the measure of drilling efficiency and the drill bit wear based on the video analytics.

14. The system of claim 13, wherein the instructions executable by the processor to cause the system to generate the drill bit wear model comprises instructions executable by the processor to cause the system to:

identify a dysfunctional instance of drilling behavior based on the measure of drilling efficiency;

identify a drill bit wear characteristic associated with the dysfunctional instance of drilling behavior; and generate the drill bit wear model that is derived from a relationship between the dysfunctional instance of drilling behavior and the drill bit wear characteristic.

15. The system of claim 13, wherein the instructions comprise instructions executable by the processor to cause the system to:

predict drill bit wear for drilling a different wellbore based on the drill bit wear model.

16. The system of claim 15, wherein the instructions comprise instructions executable by the processor to cause the system to:

mitigate drill bit wear for drilling the different wellbore based on the drill bit wear model and the predicted drill bit wear.

17. A non-transitory, machine-readable medium having instructions stored thereon that are executable by a computing device to perform operations comprising:

detecting, during a current drilling operation of a wellbore using a current drill bit, at least one drilling attribute;

determining a measure of drilling efficiency of the current drill bit based on the at least one drilling attribute, wherein the measure of drilling efficiency is based on at least one of friction factor and a mechanical specific energy (MSE);

performing video analytics of at least one video that includes at least a portion of a view of wear surfaces of the current drill bit;

determining a drill bit wear of the current drill bit based on the video analytics;

generating a drill bit wear model that defines a relationship between the measure of drilling efficiency and the drill bit wear based on the video analytics; and modifying the current drilling operation based on the measure of drilling efficiency, the drill bit wear and the drill bit wear model.

18. The non-transitory, machine-readable medium of claim 17, wherein the instructions further comprise instructions executable by the computing device to perform operations comprising:

updating the drill bit wear model based on the measure of drilling efficiency and the drill bit wear, wherein the drill bit wear model is generated from at least one prior drilling operation; and determining a cause of the drill bit wear of the current drill bit that is a result of the current drilling operation of the wellbore, wherein determining the cause of the drill bit wear is based on the measure of drilling efficiency, the drill bit wear and the drill bit wear model.

19. The non-transitory, machine-readable medium of claim 18, wherein the instructions further comprise instructions executable by the computing device to perform operations comprising:

modifying a subsequent drilling operation of the wellbore based on the cause of the drill bit wear, wherein the instructions executable by the computing device to perform operations comprising modifying the subsequent drilling operation further comprise instructions executable by the computing device to perform operations comprising at least one of:

changing a value of at least one drilling parameter of a subsequent drilling of the wellbore in comparison to the value of the at least one drilling parameter used in the current drilling operation; and selecting a different drill bit having at least one attribute that is different than the at least one attribute of the current drill bit.

20. The non-transitory, machine-readable medium of claim 17, wherein the instructions stored thereon that are executable by the computing device to perform operations comprising performing the video analytics of the at least one video further comprise instructions executable by the computing device to perform operations comprising:

processing a pre-drilling video of the at least one video of the current drill bit prior to drilling of the wellbore using the current drill bit, processing a post-drilling video of the at least one video of the current drill bit prior to drilling of the wellbore using the current drill bit, and wherein determining the drill bit wear of the current drill bit that is a result of drilling the wellbore based on the post-drilling video comprises determining the drill bit wear of the current drill bit based on a comparison of the pre-drilling video to the post-drilling video.

* * * * *